US005972580A

United States Patent [19]

Fukui et al.

[11] Patent Number: 5,972,580

[45] Date of Patent: Oct. 26, 1999

[54] DEVELOPMENT PROCESSING METHOD

[75] Inventors: Kouta Fukui; Kohzaburoh Yamada, both of Kanagawa, Japan

[73] Assignee: Fuji Photo Film Co., Ltd., Kanagawa, Japan

[21] Appl. No.: 08/976,342

[22] Filed: Nov. 21, 1997

[30] Foreign Application Priority Data

Nov. 21, 1996 [JP] Japan ..... 8-324883

[51] Int. Cl.[6] ..... G03C 5/29

[52] U.S. Cl. ..... 430/440; 430/445; 430/446; 430/488

[58] Field of Search ..... 430/440, 445, 430/446, 488

[56] References Cited

U.S. PATENT DOCUMENTS 5,264,323 11/1993 Purol et al. .
5,503,965 4/1996 Okutsu ..... 430/399
5,506,092 4/1996 Ishikawa et al. .
5,508,153 4/1996 Ishikawa et al. .
5,618,661 4/1997 Sampei .
5,707,790 1/1998 Yanagisawa .

*Primary Examiner*—Hoa Van Le
*Attorney, Agent, or Firm*—Sughrue, Mion, Zinn, Macpeak & Seas, PLLC

[57] ABSTRACT

A development processing method comprises: exposing a silver halide light-sensitive material comprising a support having thereon at least one light-sensitive silver halide emulsion layer; and developing said exposed light-sensitive material with a developing solution, wherein at least one of said silver halide emulsion layer and other hydrophilic colloidal layers contains at least one hydrazine derivative, and wherein said developing solution is substantially free from a dihydroxybenzene compound, has a pH of from 9.0 to 10.5, and contains (1) at least one ascorbic acid derivative developing agent, (2) at least one aminophenol auxiliary developing agent and (3) a specific mercaptopyrimidine compound. The processing method provides a high-contrast image required in the field of graphic arts using a developing solution having no problem with respect to the ecosystem and working environment, without causing silver stain even at a low replenishment rate.

6 Claims, No Drawings

DEVELOPMENT PROCESSING METHOD

FIELD OF THE INVENTION

The present invention relates to a method for forming an ultrahigh-contrast image using a silver halide light-sensitive material, and more particularly to a development processing method which makes it possible to obtain an ultrahigh-contrast image with a developing solution little contaminated and containing no dihydroxybenzene developing agent.

BACKGROUND OF THE INVENTION

In the field of graphic arts, in order to improve the regeneration of continuous gradation images with halftone dot images or the generation of line images, image formation systems exhibiting ultrahigh-contrast (particularly, γ is 10 or more) photographic characteristics are necessary.

As methods for obtaining high-contrast photographic characteristics, lithographic development systems utilizing the so-called "infectious development effect" have been used for long. However, they have the problem that the developing solutions are unstable and hard to use.

On the other hand, as methods using more stable developing solutions, there are methods described in U.S Pat. Nos. 4,7224,401, 4,168,977, 4,166,742, 4,311,781, 4,272,606, 4,221,857, 4,332,878, 4,634,661, 4,618,574, 4,269,922, 5,650,746 and 4,681,836.

These image formation systems are systems for processing hydrazine derivative-containing silver halide light-sensitive materials of the surface latent image type with stable MQ developing solutions (in which hydroquinone is used in combination with a p-aminophenol) or PQ developing solutions (in which hydroquinone is used in combination with a 1-phenyl-3-pyrazolidone) having a pH of 11.0 to 12.3 to obtain ultrahigh-contrast negative images in which γ exceeds 10. According to these methods, ultrahigh-contrast and high-speed photographic characteristics can be obtained, and sulfites can be added in high concentration to the developing solutions. Therefore, the stability against air oxidation of the developing solutions is far improved, compared with the conventional lithographic developing solutions.

Also for light-sensitive materials for illuminated rooms used in page make-up and dot to dot work steps, when overlay contact of halftone dot originals and line originals is tried to carry out as faithfully as the originals, methods for forming ultrahigh-contrast images are required. Also for this purpose, the above-mentioned image formation systems using hydrazine derivatives are effective, and specific applications thereof are disclosed in JP-A-62-640 (the term "JP-A" as used herein means an "unexamined published Japanese patent application"), JP-A-62-235938, JP-A-62-235939, JP-A-63-104046, JP-A-63-103235, JP-A-63-296031, JP-A-63-314541 and JP-A-64-13545.

In U.S. Pat. Nos. 4,998,604 and 4,994,365, hydrazine compounds having an ethylene oxide repeating unit and hydrazine compounds having a pyridinium group are disclosed. However, as apparent from the Examples thereof, the resulting contrast is unsatisfactory, and it is difficult to obtain sufficiently high contrast and necessary Dmax under practical developing conditions.

On the other hand, it is known that enediols such as ascorbic acid function as developing agents, and attention is given to them as developing agents having no ecological and toxicological problems. For example, in U.S. Pat. Nos. 2,688,549 and 3,826,654, it is described that image formation is possible under high alkaline conditions of pH 12 or higher. However, high-contrast images can not be obtained by these image formation methods.

Some attempts have been made to increase the contrast in development systems using ascorbic acid. For example, Zwicky describes that the use of ascorbic acid as a sole developing agent causes a kind of lithographic effect to appears (*J. Phot. Sci.*, 27, 185 (1979)). However, the contrast provided by this system was considerably low, as compared with hydroquinone development systems. Further, JP-B-49-46939 (the term "JP-B" as used herein means an "examined Japanese patent publication") disclose a system in which ascorbic acid is used in combination with a bis-quaternary ammonium salt. This system has the development accelerating effect, but scarcely shows the contrast increasing effect. JP-A-3-249756 and JP-A-4-32838 also describe the effect of using ascorbic acid in combination with a quaternary salt. However, the contrast of images obtained is not sufficient. Furthermore, JP-A-5-88306 describes that high contrast is obtained by using ascorbic acid as a sole developing agent and keeping the pH at 12.0 or higher. However, this system also has a problem with respect to the stability of a developing solution because of its high pH.

There is an example in which a particular developing solution containing ascorbic acid and a hydrazine derivative as main components is used to obtain a development system high in sensitivity and low in stain and fog (as described in U.S. Pat. No. 3,730,727). However, no reference is made therein to contrast enhancement.

It is known that light-sensitive materials containing hydrazine are processed with ascorbic acid developing solutions, and disclosed in U.S. Pat. No. 5,236,816 and WO 93/11456. However, both are insufficient in terms of the contrast. In the latter, the contrast is enhanced by adding an amine to a developing solution, but this is environmentally unfavorable. A development processing method has therefore been desired in which toxicologically preferable ascorbic acid is used as a developing agent and which provides a high-contrast image. Previously, Metol or phenidone compounds have been used as auxiliary developing agents for the ascorbic acid developing solutions. Also in the above-mentioned patents, either of these auxiliary developing agents is used.

In the usual PQ or MQ development, contamination with silver sludge in the developing solutions often causes a problem, and this problem has been desired to be solved.

The system for forming ultrahigh-contrast images using hydrazine derivatives is a system using dihydroxybenzene compounds such as hydroquinone as developing agents, as described above, and have some disadvantages from the ecological and toxicological viewpoints. For example, hydroquinone is an unfavorable component because of its allergy inducing effect, and a 1-phenyl-3-pyrazolidone compound is a component poor in biodegradation. Further, high concentrated sulfites usually show high COD (chemical oxygen demand). In this image formation system, amines as described in U.S. Pat. No. 4,975,354 are used together. They are unfavorable in terms of toxicity and volatility.

SUMMARY OF THE INVENTION

It is therefore an object of the present invention to provide a novel development processing method which provides a high-contrast image required in the field of graphic arts using a developing solution having no problem with respect to the ecosystem and working environment.

Another object of the present invention is to provide a development processing method in which the contamination in an automatic processor is decreased even when processing is conducted at a low replenishment rate and which stably provides a high-contrast image.

Other objects and effects of the present invention will become apparent from the following description.

The above described objects of the present invention have been achieved by providing a development processing method comprises:

exposing a silver halide light-sensitive material comprising a support having thereon at least one light-sensitive silver halide emulsion layer; and developing said exposed light-sensitive material with a developing solution, wherein at least one of said silver halide emulsion layer and other hydrophilic colloidal layers contains at least one hydrazine derivative, and wherein said developing solution is substantially free from a dihydroxybenzene compound, has a pH of from 9.0 to 10.5, and contains (1) at least one ascorbic acid derivative developing agent, (2) at least one aminophenol auxiliary developing agent and (3) a compound represented by formula (I):

(I)

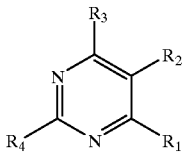

wherein $R_1$ to $R_4$, which may be the same of different, each represents a hydrogen atom, a halogen atom or a substituent group bonded to the ring in formula (I) with a carbon atom, a nitrogen atom, an oxygen atom, a sulfur atom or a phosphorus atom contained in the substituent, with the proviso that $R_1$ and $R_3$ each does not represent a hydroxyl group, and that at least one of $R_1$ to $R_4$ is an -SM group, wherein M represents a hydrogen atom, an alkali metal atom or an ammonium group.

DETAILED DESCRIPTION OF THE INVENTION

The developing solution for use in the present invention is described in detail below.

The developing solution for use in processing the light-sensitive material in the present invention can contain additives usually employed (for example, developing agents, alkali agents, pH buffers, preservatives or chelating agents). In the processing of the present invention, any of the known methods can be used, and the developing solutions known in the art can be used.

A developing agent contained in the developing solution for use in the present invention is an ascorbic acid derivative, and the developing solution is substantially free from dihydroxybenzene developing agents. The phrase "substantially free from" used herein means that the amount of dihydroxybenzene developing agents contained in the developer is 0.1 g/liter or less.

Preferred ascorbic acid derivative developing agents for use in the present invention are those represented by formula (III):

(III)

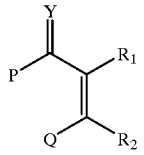

wherein $R_1$ and $R_2$ each represents a hydroxyl group, an amino group (including a group having an alkyl group of 1 to 10 carbon atoms such as methyl, ethyl, n-butyl or hydroxyethyl, as a substituent group), an acylamino group (such as acetylamino or benzoylamino), an alkylsulfonylamino group (such as methanesulfonylamino), an arylsulfonylamino group (benzenesulfonylamino or p-toluenesulfonylamino), an alkoxycarbonylamino group (methoxycarbonylamino), a mercapto group or an alkylthio group (such as methylthio or ethylthio). Preferred examples of $R_1$ and $R_2$ include hydroxyl, amino, alkylsulfonylamino and arylsulfonylamino groups.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group or a mercapto group, or an atomic group necessary to form a 5-, 6- or 7-membered ring together with the two vinyl carbon atoms at which $R_1$ and $R_2$ are substituted and the carbon atom at which Y is substituted. Specific examples of such ring structures include combinations of two or more of —O—, —C($R_4$)($R_5$)—, —C($R_6$)═, —C(═O)—, —N($R_7$)— and —N═, wherein $R_4$, $R_5$, $R_6$ and $R_7$ each represents a hydrogen atom, an alkyl group having 1 to 10 carbon atoms which may be substituted (substituent groups include hydroxyl, carboxyl and sulfo groups), a hydroxyl group or a carboxyl group. Further, saturated or unsaturated condensed rings may be formed on the 5- to 7-membered rings.

Examples of the 5- to 7-membered rings include dihydrofuranone, dihydropyrone, pyranone, cyclopentenone, cyclohexenone, pyrrolinone, pyrazolinone, pyridone, azacyclohexenone and uracil rings. Preferred examples thereof include dihydrofuranone, cyclopentenone, cyclohexenone, pyrazolinone, azacyclohexenone and uracil rings.

Y is a group composed of ═O or ═N—$R_3$, wherein $R_3$ represents a hydrogen atom, a hydroxyl group, an alkyl group (for example, methyl or ethyl), an acyl group (for example, acetyl), a hydroxyalkyl group (for example, hydroxymethyl or hydroxyethyl), a sulfoalkyl group (for example, sulfomethyl or sulfoethyl) or a carboxyalkyl group (for example, carboxymethyl or carboxyethyl).

Specific examples of the compounds represented by formula (III) are enumerated below, but the present invention is not limited thereto.

1-1

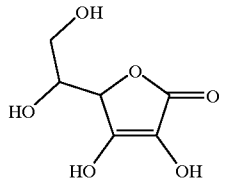

-continued
1-2
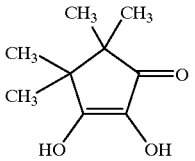
1-3
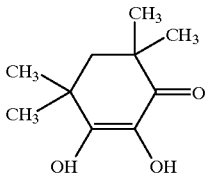
1-4
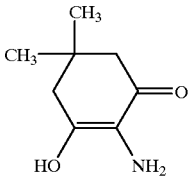
1-5
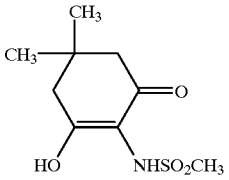
1-6
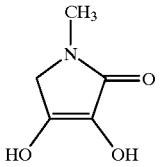
1-7
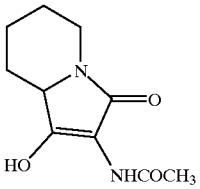
1-8
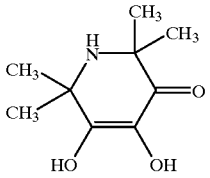
1-9
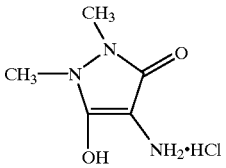
-continued
1-10
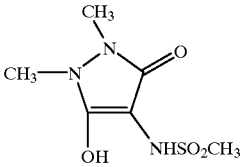
1-11
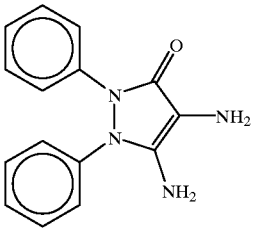
1-12
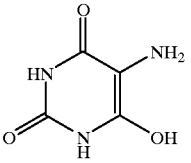
1-13
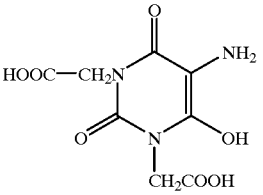
1-14
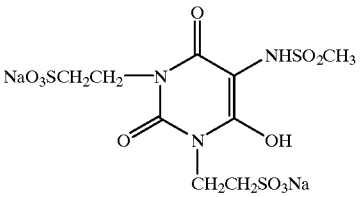
1-15
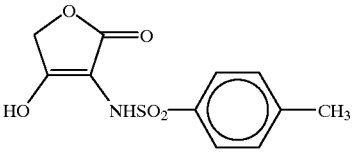
1-16
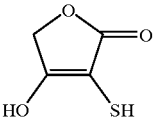
1-17
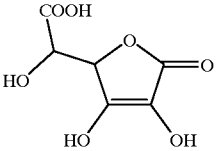

-continued 1-18

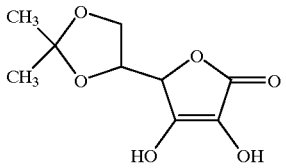

1-19

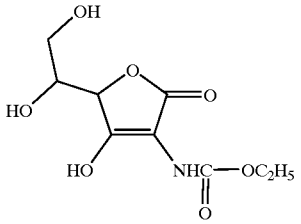

1-20

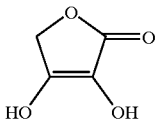

1-21

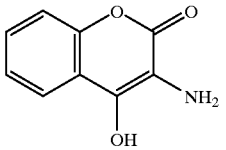

1-22

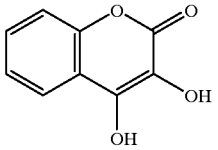

1-23

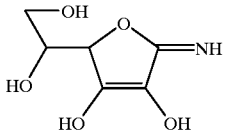

1-24

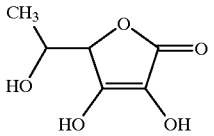

1-25

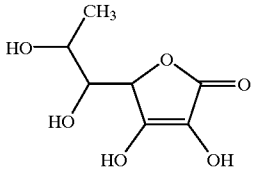

1-26

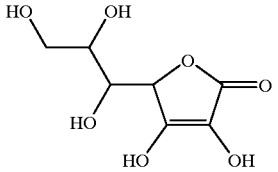

-continued 1-27

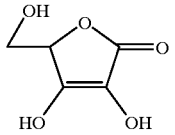

1-28

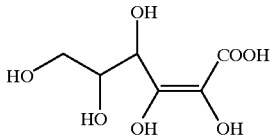

1-29

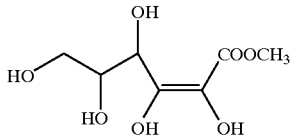

1-30

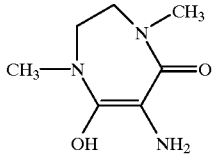

1-31

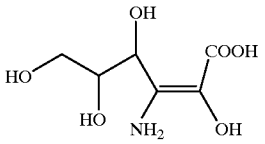

Of these, ascorbic acid and erysorbic acid (a diastereomer of ascorbic acid) are preferred.

As the ascorbic acid derivatives for use in the developing solution in the present invention, the endiol type, enaminol type, the endiamin type, the thiol-enol type and the enaminthiol type are generally known. Examples of these compounds are described in U.S. Pat. No. 2,688,549 and JP-A-62-237443. Synthesis methods of these ascorbic acid derivatives are also well known, and are described, for example, in Tsugio Nomura and Hirohisa Ohmura, *Chemistry of Reductons*, Uchida Rohkakuho Shinsha (1969). The ascorbic acid derivatives used in the present invention can also be used in the form of alkali metal salts such as lithium salts, sodium salts and potassium salts.

The compound represented by formula (III) is used generally in an amount of $5\times10^{-3}$ to 1 mol, and preferably in an amount of $10^{-2}$ to 0.5 mol, per liter of the developing solution.

The ascorbic acid derivative developing agent is usually used preferably in an amount of 0.05 mol/liter to 1.0 mol/liter, and more preferably in an amount of 0.1 mol/liter to 0.5 mol/liter. In a combination of the ascorbic acid derivative and the aminophenol, it is preferred to use the former in an amount of 0.05 mol/liter to 1.0 mol/liter, more preferably in an amount of 0.1 mol/liter to 0.5 mol/liter, and the latter in an amount of 0.2 mol/liter or less, more preferably in an amount of 0.1 mol/liter or less.

The aminophenol developing agent for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol and o-methoxy-p-(N-methylamino)

phenol, and aminophenols represented by formula (II) shown below are preferred among others.

The compounds represented by formula (I) are described in detail below.

$R_1$ to $R_4$ each represents a hydrogen atom, a halogen atom or a substituent group bonded to a ring with a carbon atom, a nitrogen atom, an oxygen atom, a sulfur atom or a phosphorus atom contained in the substituent, with the proviso that $R_1$ and $R_3$ each does not represent a hydroxyl group. At least one of $R_1$ to $R_4$, which may be the same or different, is an -SM group (wherein M represents a hydrogen atom, an alkali metal atom or an ammonium group).

Specific examples of the substituent group represented by $R_1$ to $R_4$ include halogen atoms (such as fluorine, chlorine, bromine and iodine), alkyl (such as aralkyl, cycloalkyl and active methine groups), alkenyl, alkynyl, aryl, heterocyclic, quaternized nitrogen atom-containing heterocyclic (for example, pyridinio), acyl, alkoxycarbonyl, aryloxycarbonyl, carbamoyl, urethane, carboxyl or salts thereof, sulfonylcarbamoyl, acylcarbamoyl, sulfamoyl-carbamoyl, carbazoyl, oxalyl, oxamoyl, cyano, thiocarbamoyl, hydroxyl, alkoxyl (including groups repeatedly containing ethyleneoxy group or propyleneoxy group units), aryloxy, heterocyclic oxy, acyloxy, (alkoxy or aryloxy)carbonyloxy, carbamoyloxy, sulfonyloxy, amino, (alkyl, aryl or heterocyclic) amino, hydroxyamino, N-substituted saturated or unsaturated nitrogen atom-containing heterocyclic, acylamino, sulfonamido, ureido, thioureido, (alkoxy or aryloxy)carbonylamino, sulfamoylamino, semicarbazido, thiosemicarbazido, hydrazino, quaternary ammonio, oxamoylamino, (alkyl or aryl)sulfonylureido, acylureido, acylsulfamoylamino, nitro, mercapto, (alkyl, aryl or heterocyclic) thio, (alkyl or aryl)sulfonyl, (alkyl or aryl) sulfonyl, sulfo or salts thereof, sulfamoyl, acylsulfamoyl, sulfonylsulfamoyl or salts thereof, and groups having the phosphoric acid amide or phosphoric acid ester structure.

However, $R_1$ and $R_3$ each does not represent a hydroxyl group.

These substituent groups may be further substituted by these substituent groups.

Preferred examples of the substituent groups represented by $R_1$ to $R_4$ are substituent groups each having 0 to 15 carbon atoms, which include chlorine, alkyl, aryl, heterocyclic, acyl, alkoxycarbonyl, carbamoyl, carboxyl or salts thereof, cyano, alkoxyl, aryloxy, acyloxy, amino, (alkyl, aryl or heterocyclic) amino, hydroxyamino, N-substituted saturated or unsaturated nitrogen atom-containing heterocyclic, acylamino, sulfonamido, ureido, thioureido, sulfamoylamino, nitro, mercapto, (alkyl, aryl or heterocyclic) thio, sulfo or salts thereof and sulfamoyl, more preferably alkyl, aryl, heterocyclic, alkoxycarbonyl, carbamoyl, carboxyl or salts thereof, alkoxyl, aryloxy, acyloxy, amino, (alkyl, aryl or heterocyclic) amino, hydroxyamino, N-substituted saturated or unsaturated nitrogen atom-containing heterocyclic, acylamino, sulfonamido, ureido, thioureido, sulfamoylamino, mercapto, (alkyl, aryl or heterocyclic) thio and sulfo or salts thereof, and most preferably amino, alkyl, aryl, alkoxyl, aryloxy, alkylamino, arylamino, alkylthio, arylthio, mercapto, carboxyl or salts thereof and sulfo or salts thereof.

In formula (I), at least one of $R_1$ to $R_4$ is an -SM group, and more preferably, at least two of them are -SM groups. When at least two of $R_1$ to $R_4$ are -SM groups, $R_4$ and $R_1$, or $R_4$ and $R_3$ are preferably -SM groups.

In formula (I), M represents an alkali metal atom, a hydrogen atom or an ammonium group. Specific examples of the alkali metal atoms include Na, K, Li, Mg and Ca, which are present as counter cations of —$S^-$. M is preferably a hydrogen atom, an ammonium group, $Na^+$ or $K^+$, and more preferably a hydrogen atom.

In the present invention, of the compounds represented by formula (I), compounds represented by the following formulae (1) to (3) are particularly preferred:

(1)

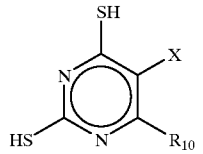

(2)

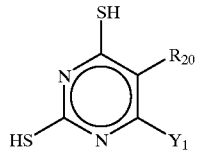

(3)

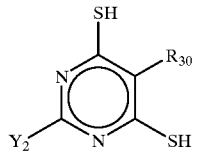

In formula (1), $R_{10}$ represents a mercapto group, a hydrogen atom or a substituent group, and X represents a water-soluble group or a substituent group substituted by a water-soluble group. In formula (2), $Y_1$ represents a water-soluble group or a substituent group substituted by a water-soluble group, and $R_{20}$ represents a hydrogen atom or a substituent group. In formula (3), $Y_2$ represents a water-soluble group or a substituent group substituted by a water-soluble group, and $R_{30}$ represents a hydrogen atom or a substituent group. However, $R_{10}$ and $Y_1$ do not represent hydroxyl groups.

The compounds represented by formulae (1) to (3) are described in detail below.

In formula (1), $R_{10}$ represents a mercapto group, a hydrogen atom or a substituent group, with the proviso that $R_{10}$ does not represent a hydroxyl group.

The substituent group as used herein includes the same groups as described for $R_1$ to $R_4$ of formula (1). $R_{10}$ is preferably a group selected from a mercapto group, a hydrogen atom and a substituent group having 0 to 15 carbon atoms. That is, such substituent groups include amino, alkyl, aryl, alkoxyl, aryloxy, acylamino, sulfonamido, alkylthio, arylthio, alkylamino and arylamino.

In formula (1), X represents a water-soluble group or a substituent group substituted by a water-soluble group. The water-soluble group as used herein is a sulfonic acid or a salt thereof, a carboxylic acid or a salt thereof, a salt such as an ammonio group, or a group containing a dissociative group which can be partly or completely dissociated with an alkaline developing solution. Specific examples thereof include sulfo (or salts thereof), carboxyl (or salts thereof), hydroxyl, mercapto, amino, ammonio, sulfonamido, acylsulfamoyl, sulfonylsulfamoyl, active methine groups and substituent groups containing these groups. In the present invention, the active methine groups are methyl groups each substituted by two electron attractive groups, and specific examples thereof include dicyanomethyl, α-cyano-α-ethoxycarbonylmethyl and α-acetyl-α-ethoxycarbonylmethyl groups.

The substituent group represented by X in formula (1) is the above-mentioned water-soluble group or the above-mentioned substituent group substituted by the water-soluble group. The substituent group thereof are substituent groups each having 0 to 15 carbon atoms, which include alkyl, aryl, heterocyclic, alkoxyl, aryloxy, heterocyclic oxy, acyloxy, (alkyl, aryl or heterocyclic) amino, acylamino, sulfonamido, ureido, thioureido, imido, sulfamoylamino, (alkyl, aryl or heterocyclic) thio, (alkyl or aryl)sulfonyl, sulfamoyl and amino, and preferably alkyl having 1 to 10 carbon atoms (particularly, a methyl group substituted by an amino group), aryl, aryloxy, amino, (alkyl, aryl or heterocyclic) amino and (alkyl, aryl or heterocyclic) thio.

Of the compounds represented by formula (1), compounds represented by the following formula (1-a) are more preferred.

(1-a)

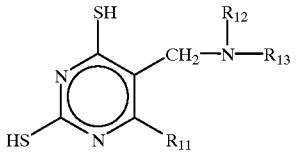

wherein $R_{11}$ has the same meaning as given for $R_{10}$ of formula (1), and preferred groups are also the same as given therefor. $R_{12}$ and $R_{13}$, which may be the same or different, each represents a hydrogen atom, an alkyl group, an aryl group or a heterocyclic group, with the proviso that at least one of $R_{12}$ and $R_{13}$ has at least one water-soluble group. The water-soluble groups as used herein include sulfo (or salts thereof), carboxyl (or salts thereof), hydroxyl, mercapto, amino, ammonio, sulfonamido, acylsulfamoyl, sulfonylsulfamoyl, active methine and substituent groups containing these groups, and preferably sulfo (or salts thereof), carboxyl (or salts thereof), hydroxyl and amino.

$R_{12}$ and $R_{13}$ are each preferably an alkyl group or an aryl group. When $R_{12}$ and $R_{13}$ are each an alkyl group, the alkyl group is preferably a substituted or unsubstituted alkyl group having 1 to 4 carbon atoms, and the substituent group thereof is preferably a water-soluble group, particularly sulfo (or a salt thereof), carboxyl (or a salt thereof), hydroxyl or amino. When $R_{12}$ and $R_{13}$ are each an aryl group, the aryl group is preferably a substituted or unsubstituted phenyl group having 6 to 10 carbon atoms, and the substituent group thereof is preferably a water-soluble group, particularly sulfo (or a salt thereof), carboxyl (or a salt thereof), hydroxyl or amino.

When $R_{12}$ and $R_{13}$ each represents an alkyl group or an aryl group, they may combine with each other to form a cyclic structure. Further, a saturated heterocycle may be formed by the cyclic structure.

In formula (2), $Y_1$ represents a water-soluble group or a substituent group substituted by a water-soluble group, and has the same meaning as given for X of formula (1), with the proviso that $Y_1$ does not represent a hydroxyl group.

In formula (2), the water-soluble group or the substituent group substituted by the water-soluble group represented by $Y_1$ is preferably an active methine group, or amino, alkoxyl, aryloxy, alkylthio, arylthio, alkyl or aryl substituted by a water-soluble group. $Y_1$ is more preferably an active methine group or an (alkyl, aryl or heterocyclic) amino group substituted by a water soluble group, wherein a hydroxyl group, a carboxyl group or a salt thereof, or a sulfo group or a salt thereof is particularly preferred as the water-soluble group.

$Y_1$ is particularly preferably an (alkyl, aryl or heterocyclic) amino group substituted by a hydroxyl group, a carboxyl group (or a salt thereof) or a sulfo group (or a salt thereof), which is represented by an —$N(R_{01})(R_{02})$ group wherein $R_{01}$ and $R_{02}$ have the same meanings as given for $R_{12}$ and $R_{13}$ of formula (1-a), and preferred groups are also the same as given therefor.

In formula (2), $R_{20}$ represents a hydrogen atom or a substituent group. The substituent group as used herein includes the same groups as described for $R_1$ to $R_4$ of formula (1). $R_{20}$ is preferably a group selected from a hydrogen atom and a substituent group having 0 to 15 carbon atoms. That is, such substituent groups include hydroxyl, amino, alkyl, aryl, alkoxyl, aryloxy, acylamino, sulfonamido, alkylthio, arylthio, alkylamino, arylamino and hydroxylamino. $R_{20}$ is most preferably a hydrogen atom.

In formula (3), $Y_2$ represents a water-soluble group or a substituent group substituted by a water-soluble group, and $R_{30}$ represents a hydrogen atom or a substituent group. $Y_2$ and $R_{30}$ in formula (3) have the same meanings as given for $Y_1$ and $R_{20}$ in formula (2), respectively, and preferred groups are also the same as given therefor.

Specific examples of the compounds represented by formula (I) in the present invention are enumerated below, but needless to say, the present invention is not limited thereto.

1

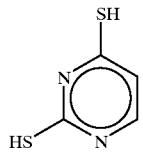

2

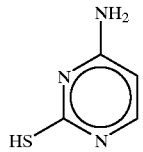

3

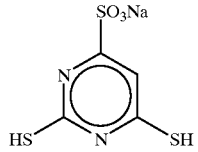

4

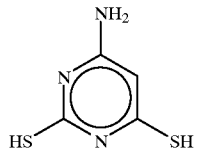

5

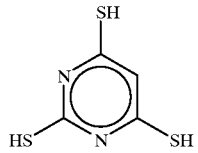

-continued
6
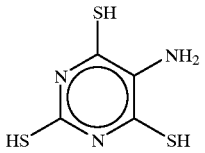
7
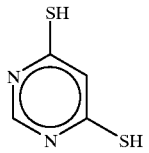
8
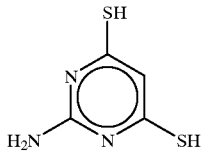
9
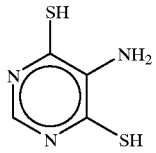
10
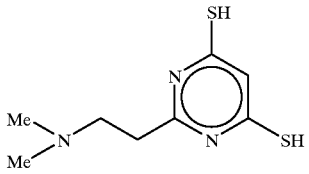
11
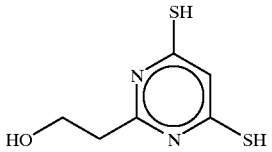
12
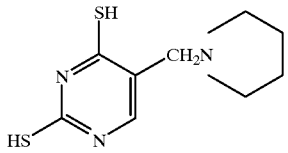
13
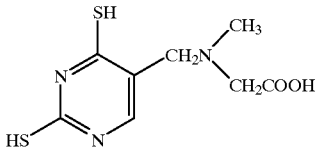
14
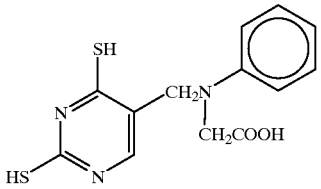
-continued
15
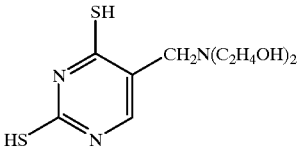
16
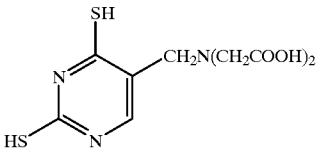
17
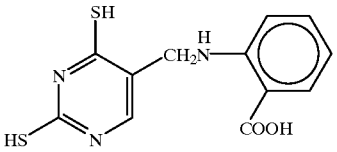
18
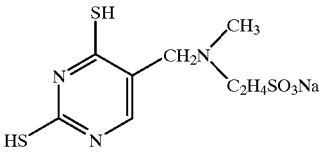
19
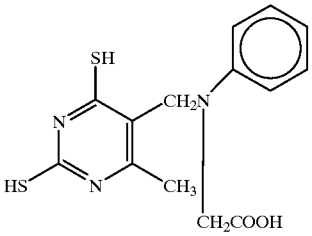
20
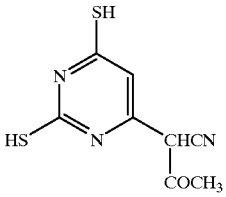
21
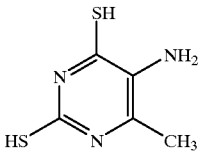
22
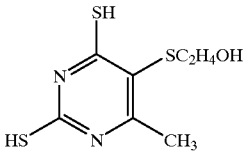

-continued
23
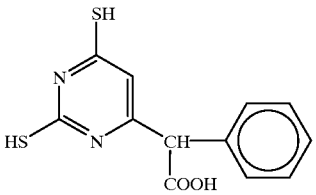
24
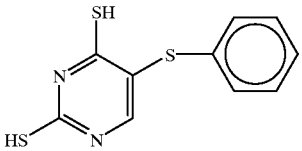
25
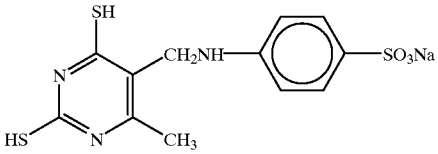
26
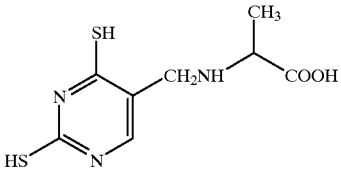
27
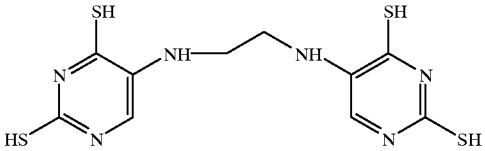
28
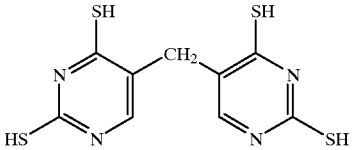
29
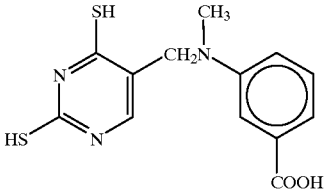
30
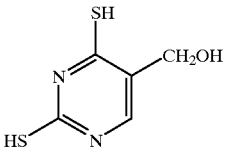
-continued
31
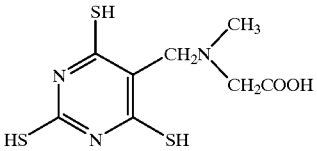
32
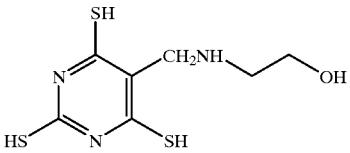
33
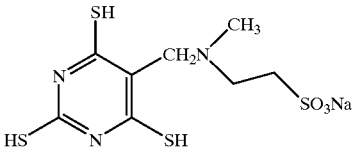
34
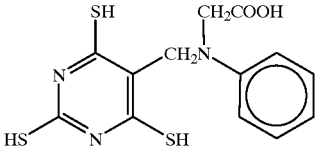
35
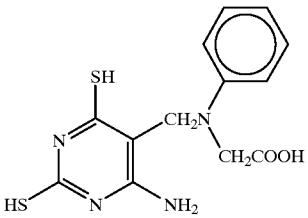
36
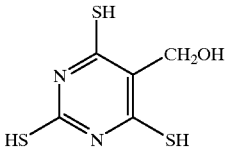
37
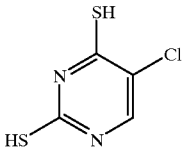
38
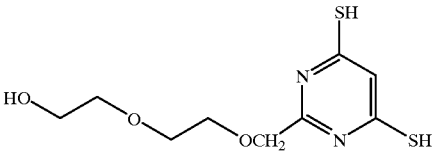

-continued
39
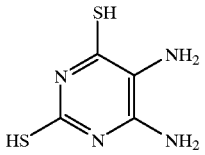
40
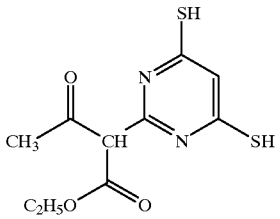
41
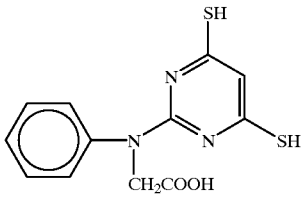
42
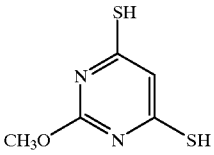
43
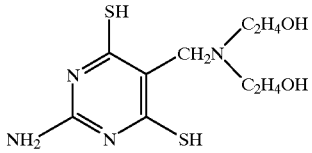
44
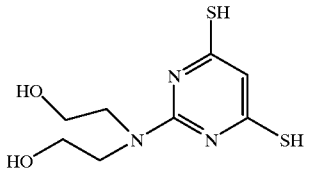
45
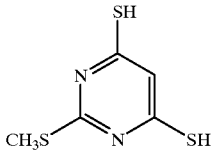
46
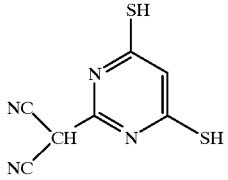
-continued
47
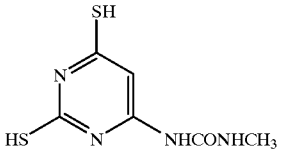
48
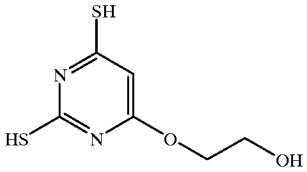
49
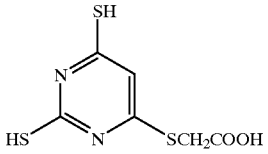
50
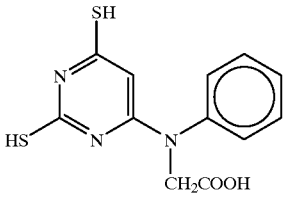
51
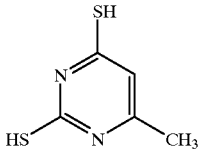
52
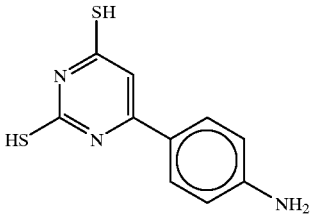
53
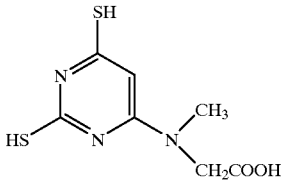
54
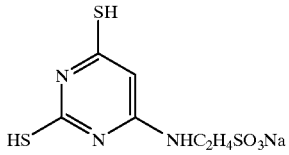

-continued
55
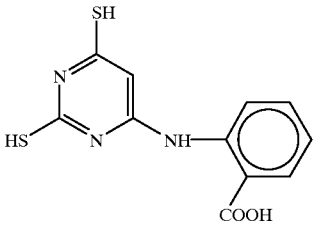
56
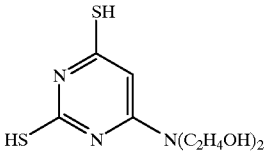
57
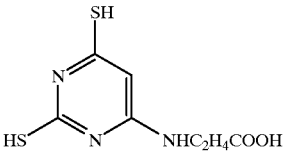
58
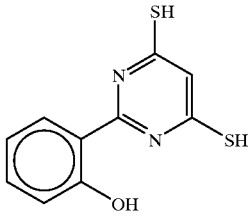
59
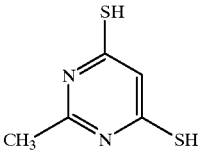
60
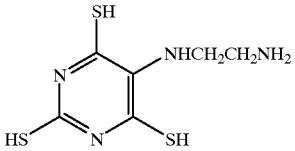
61
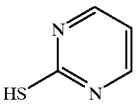
62
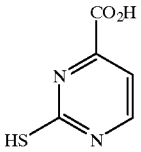
-continued
63
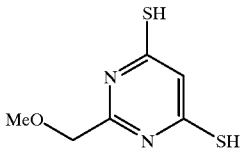
64
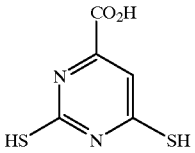
65
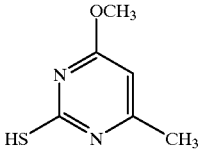
66
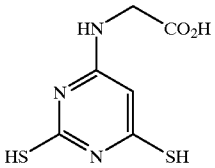
67
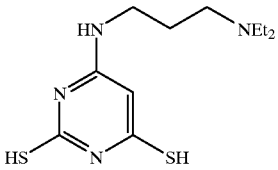
68
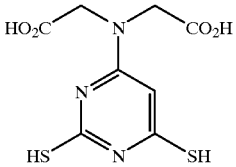
69
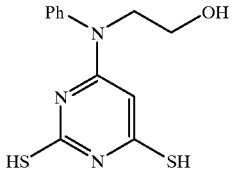
70
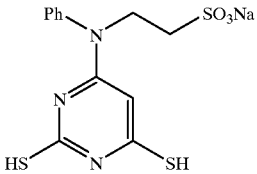

-continued
71
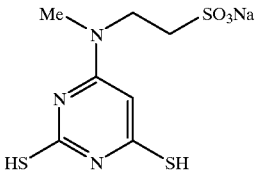
72
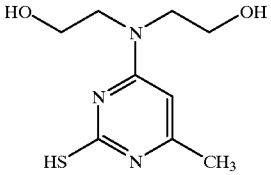
73
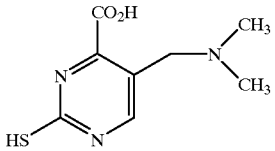
74
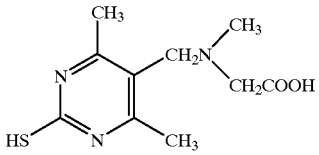
75
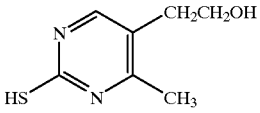
76
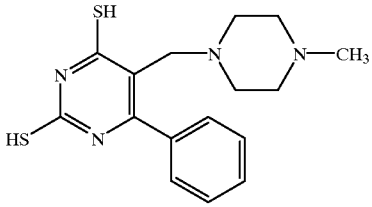
77
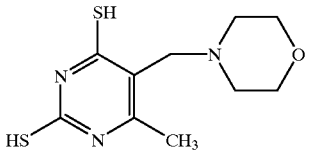
78
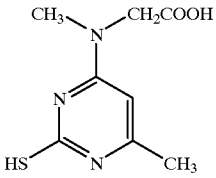
-continued
79
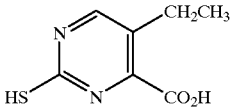
80
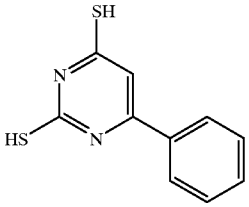
81
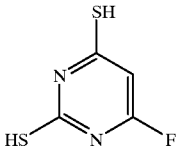
82
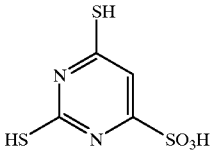
83
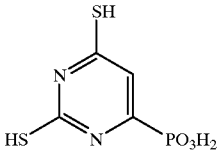
84
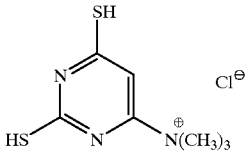
85
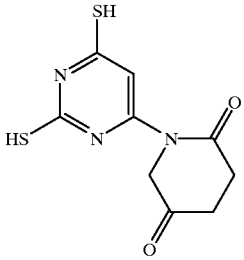
86
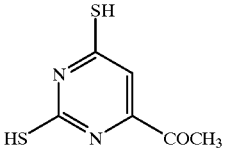

-continued

87

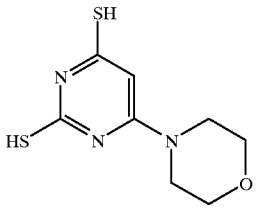

88

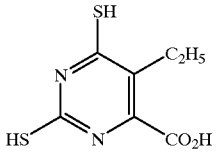

89

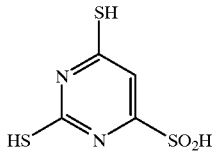

90

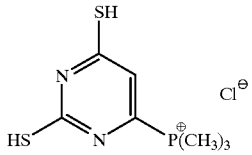

91

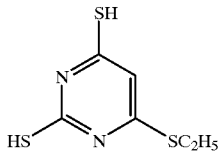

92

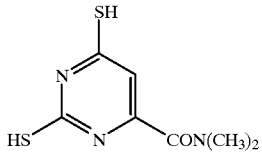

93

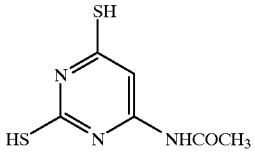

94

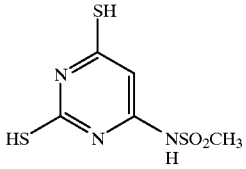

-continued

95

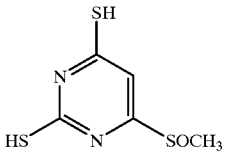

96

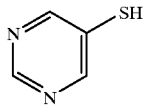

97

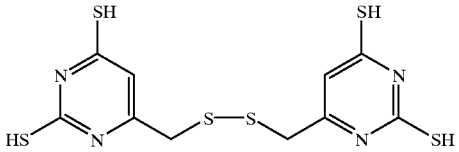

98

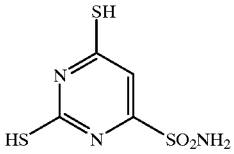

99

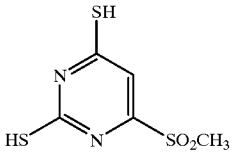

100

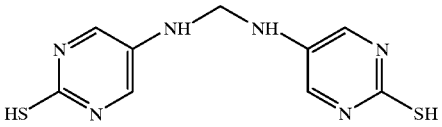

The compound represented by formula (I) is generally added in an amount of 0.01 to 10 mmol, and preferably in an amount of 0.1 to 5 mmol. When they are added to silver halide light-sensitive materials, it is preferred that they are added to light-insensitive layers such as back layers and uppermost protective layers. In this case, they are added preferably in an amount ranging from $1\times10^{-6}$ mol to $5\times10^{-3}$ mol, and more preferably in an amount ranging from $1\times10^{-5}$ mol to $1\times10^{-3}$ mol, per $m^2$ of the light-sensitive material.

Compounds represented by formula (II) are described in detail.

(II)

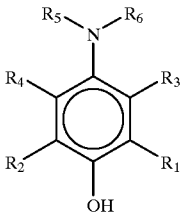

wherein $R_1$, $R_2$, $R_3$ and R4, which may be the same or different, each represents a hydrogen atom or a substituent group. $R_5$ and $R_6$, which may be the same or different, each represents an alkyl group, an aryl group, aralkyl group or a heterocyclic group.

p-Aminophenols represented by formula (II) are described in detail.

In formula (II), $R_1$, $R_2$, $R_3$ and $R_4$, which may be the same or different, each represents a hydrogen atom or a substituent group. Examples of the substituent group include alkyl, aryl, aralkyl, heterocyclic, halogen atoms, cyano, nitro, mercapto, hydroxyl, alkoxyl, aryloxy, alkylthio, arylthio, acyloxy, amino, alkylamino, carbonamido, sulfonamido, sulfamoylamino, ureido, acyl, oxycarbonyl carbamoyl, sulfonyl, sulfonyl, sulfamoyl, carboxyl (including salts thereof) and sulfo (including salts thereof). They may be substituted by a substituent group such as alkyl, alkenyl, alkynyl, aryl, halogen atoms, cyano, nitro, hydroxyl, alkoxyl, aryloxy, alkylthio, amino, alkylamino, ammonio, carbonamido, sulfonamido, sulfamoylamino, ureido, carbamoyl, sulfamoyl, carboxyl (including salts thereof) and sulfo (including salts thereof), or other substituent groups composed of an oxygen atom, a nitrogen atom, a sulfur atom or a carbon atom.

Examples of the substituent groups represented by $R_1$, $R_2$, $R_3$ and $R_4$ are shown in more detail. The alkyl groups are straight-chain, branched-chain or cyclic alkyl groups each having 1 to 10 carbon atoms, and examples thereof include methyl, ethyl, propyl, isopropyl, t-butyl, cyclopentyl, cyclohexyl, benzyl, hydroxymethyl, 2-hydroxyethyl, 3-hydroxypropyl, 2,3-dihydroxypropyl and 2-methoxyethyl.

The aryl groups are aryl groups each having 6 to 10 carbon atoms, and examples thereof include phenyl, naphthyl and p-methoxyphenyl. The aralkyl groups are aralkyl groups each having 7 to 10 carbon atoms, and examples thereof include benzyl. The heterocyclic groups are 5- or 6-membered saturated or unsaturated heterocyclic groups composed of carbon atoms, nitrogen atoms, oxygen atoms or sulfur atoms. The rings may be composed of one or more kinds of heteroatoms. Examples of the heterocyclic groups include 2-furyl, 2-pyrrolyl, 2-imidazolyl, 1-pyrazolyl, 2-pyridyl, 2-pyrimidyl and 2-thienyl. The halogen atoms are, for example, fluorine and chlorine atoms. The alkoxyl groups are alkoxyl groups each having 1 to 10 carbon atoms, preferably 1 to 6 carbon atoms, and examples thereof include methoxy, ethoxy, propoxy, isopropoxy, 2-hydroxyethoxy, 3-hydroxypropoxy, 2-methoxyethoxy, hydroxyethoxyethoxy, 2,3-dihydroxypropoxy, 2-hydroxypropoxy and 2-methanesulfonylethoxy. The aryloxy groups are aryloxy groups each having 6 to 10 carbon atoms, and examples thereof include phenoxy, p-carboxyphenoxy and o-sulfophenoxy. The alkylthio groups are alkylthio groups each having 1 to 10 carbon atoms, preferably 1 to 6 carbon atoms, and examples thereof include methylthio and ethylthio. The arylthio groups are arylthio groups each having 6 to 10 carbon atoms, and examples thereof include phenylthio and 4-methoxyphenylthio. The acyloxy groups are acyloxy groups each having 1 to 10 carbon atoms, preferably 1 to 6 carbon atoms, and examples thereof include acetoxy and propanoyloxy.

The alkylamino groups are alkylamino groups each having 1 to 10 carbon atoms, preferably 1 to 6 carbon atoms, and examples thereof include methylamino, diethylamino and 2-hydroxyethylamino. The carbonamido groups are carbonamido groups each having 1 to 10 carbon atoms, preferably 1 to 6 carbon atoms, and examples thereof include acetamido and propionamido. The sulfonamido groups are sulfonamido groups each having 1 to 10 carbon atoms, preferably 1 to 6 carbon atoms, and examples thereof include methanesulfonamido. The sulfamoylamino groups are sulfamoylamino groups each having 0 to 10 carbon atoms, preferably 0 to 6 carbon atoms, and examples thereof include methylsulfamoylamino and dimethylsulfamoylamino. The ureido groups are ureido groups each having 1 to 10 carbon atoms, preferably 1 to 6 carbon atoms, and examples thereof include ureido, methylureido, N,N-dimethylureido. The acyl groups are acyl groups each having 1 to 10 carbon atoms, preferably 1 to 6 carbon atoms, and examples thereof include acetyl and benzoyl. The oxycarbonyl groups are oxycarbonyl groups each having 1 to 10 carbon atoms, preferably 1 to 6 carbon atoms, and examples thereof include methoxycarbonyl and ethoxycarbonyl. The carbamoyl groups are carbamoyl groups each having 1 to 10 carbon atoms, preferably 1 to 6 carbon atoms, and examples thereof include carbamoyl, N,N-dimethylcarbamoyl and N-ethylcarbamoyl. The sulfonyl groups are sulfonyl groups each having 1 to 10 carbon atoms, preferably 1 to 6 carbon atoms, and examples thereof include methanesulfonyl and ethanesulfonyl. The sulfonyl groups are sulfonyl groups each having 1 to 10 carbon atoms, preferably 1 to 6 carbon atoms, and examples thereof include methanesulfonyl. The sulfamoyl groups are sulfamoyl groups each having 0 to 10 carbon atoms, preferably 0 to 6 carbon atoms, and examples thereof include sulfamoyl and dimethylsulfamoyl.

$R_5$ and $R_6$, which may be the same or different, each represents an alkyl group, an aryl group, aralkyl group or a heterocyclic group. They have the same meaning as given for $R_1$, $R_2$, $R_3$ and $R_4$. However, when $R_5$ and $R_6$ are alkyl groups, they may combine with each other to form a 5- or 6-membered ring together with a nitrogen atom. In this case, such rings include, for example, pyrrolidine, piperidine, piperazine and morpholine rings. Further, when at least one of $R_5$ and $R_6$ is an alkyl group and at least one of $R_3$ and $R_4$ is an alkyl group or an alkoxyl group, they may combine with each other to form a condensed heterocycle together with a nitrogen atom and a benzene ring. The 5- and 6-membered rings formed by condensation with benzene rings include, for example, indole, indoline, dihydroquinoline, tetrahydroquinoline and benzoxazine.

The compounds represented by formula (II) may be dimers to form the bis-type structure.

Of the compounds represented by formula (II), compounds represented by the following formula (A) are preferred.

(A)

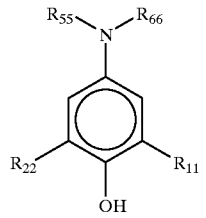

wherein $R_{11}$, and $R_{22}$, which may be the same or different, each represents a hydrogen atom or a substituent group; and $R_{55}$ and $R_{66}$, which may be the same or different, each represents an alkyl group, an aryl group, an aralkyl group or a heterocyclic group.

With respect to $R_{11}$ and $R_{22}$, and $R_{55}$ and $R_{66}$ in formula (A), preferred combinations thereof are described below.

A combination is preferred in which $R_{11}$ and $R_{22}$ are hydrogen, alkyl, hydroxyl, alkoxyl, amino, alkylamino, carbonamido, sulfonamido, sulfamoylamino or ureido, and $R_{55}$ and $R_{66}$ are alkyl, wherein alkyl, alkoxyl or alkylamino may be substituted by another substituent group.

In this combination, it is more preferred that $R_{55}$ and $R_{66}$ are each an unsubstituted alkyl group or an alkyl group substituted by a water-soluble group. Here, the water-soluble groups are hydroxyl, alkoxyl, amino, alkylamino, ammonio, carbonamido, sulfonamido, sulfamoylamino, ureido, carbamoyl, sulfamoyl, carboxyl (including salts thereof) and sulfo (including salts thereof).

More preferred compounds are compounds in which $R_{11}$ is hydrogen, $R_{22}$ is alkyl, alkoxyl, carbonamido, sulfonamido, sulfamoylamino or ureido, and $R_{55}$ and $R_{66}$ are alkyl in formula (A), wherein alkyl, alkoxyl, carbonamido, sulfonamido, sulfamoylamino and ureido include groups substituted by hydroxyl, alkoxyl, amino, alkylamino, ammonio, carbonamido, sulfonamido, sulfamoylamino or ureido.

Still more preferred compounds are compounds in which $R_{11}$ is hydrogen, $R_{22}$ is alkyl having 1 to 3 carbon atoms, alkoxyl having 1 to 4 carbon atoms, carbonamido having 1 to 3 carbon atoms, sulfonamido having 1 to 3 carbon atoms, sulfamoylamino having 1 to 3 carbon atoms, or ureido having 1 to 3 carbon atoms, and $R_{55}$ and $R_{66}$ are unsubstituted alkyl having 1 to 3 carbon atoms in formula (A), wherein alkyl and alkoxyl represented by $R_{22}$ include groups substituted by hydroxyl, alkoxyl, carbonamido or sulfonamido.

Most preferred compounds are compounds in which $R_{11}$ is hydrogen, $R_{22}$ is alkyl having 1 to 3 carbon atoms, alkoxyl having 1 to 4 carbon atoms, carbonamido having 1 to 3 carbon atoms, sulfonamido having 1 to 3 carbon atoms or ureido having 1 to 3 carbon atoms, and $R_{55}$ and $R_{66}$ are each methyl in formula (A), wherein alkyl and alkoxyl represented by $R_{22}$ include groups substituted by hydroxyl or alkoxyl.

Specific examples of the compounds used in the present invention include but are not limited to the following compounds.

The compounds represented by formula (A) may be unstable as free aniline. It is therefore preferred that they are produced and stored as salts with inorganic or organic acids, and converted to free aniline after addition thereof to processing solutions. The inorganic or organic acids forming salts with the compounds represented by formula (A) include, for example, hydrochloric acid, hydrobromic acid, sulfuric acid, p-toluenesulfonic acid, methanesulfonic acid and naphthalene-1,5-disulfonic acid. In particular, it is preferable to form salts of sulfuric acid or naphthalene-1,5-disulfonic acid.

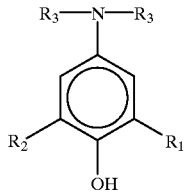

| No. | $R_1$ | $R_2$ | $R_3$ |
|---|---|---|---|
| A-1 | —H | —H | —$CH_3$ |
| A-2 | —$OCH_3$ | —H | —$CH_3$ |
| A-3 | —$OCH_3$ | —$OCH_3$ | —$CH_3$ |
| A-4 | —$NHCOCH_3$ | —H | " |
| A-5 | —$NHCOCH_3$ | —$NHCOCH_3$ | " |
| A-6 | —$NHCONHCH_3$ | —H | " |
| A-7 | —$NHCONH_2$ | —H | " |
| A-8 | —$CH_2OH$ | —$CH_2OH$ | " |
| A-9 | —$NHSO_2CH_3$ | —H | " |
| A-10 | —OH | —H | " |
| A-11 | —$NH_2$ | —H | " |
| A-12 | —$NHSO_2NH_2$ | —H | " |
| A-13 | —$NHCH_3$ | —H | —$CH_3$ |
| A-14 | —$NHSO_2N(CH_3)_2$ | " | " |
| A-15 | —$CH_3$ | —$CH_3$ | " |
| A-16 | —$CH_2\overset{\oplus}{N}(CH_3)_3$ $Cl^{\ominus}$ | —H | " |
| A-17 | —H | " | —$C_2H_5$ |
| A-18 | —$OCH_3$ | " | " |
| A-19 | —$NHCONH_2$ | " | " |
| A-20 | —$NHCSNH_2$ | " | —$CH_3$ |
| A-21 | —$OCH_2CH_2NHSO_2CH_3$ | " | " |
| A-22 | —$OCH_2CH_2OH$ | " | " |
| A-23 | —$OCH_2CH_2OCH_3$ | " | " |
| A-24 | —$OCH_2CH_2CH_2OH$ | " | " |
| A-25 | —$OCH_2CH_2CH_2OCH_3$ | —H | —$CH_3$ |

-continued

| | | | |
|---|---|---|---|
| A-26 | —$OCH_2CH(OH)CH_2OH$ | " | " |
| A-27 | —$OCH_2CH_2OCH_2CH_2OH$ | " | " |
| A-28 | —$OCH_2CH(CH_3)OH$ | " | " |
| A-29 | —$SC_2H_5$ | " | " |
| A-30 | —$SCH_2CH_2OH$ | " | " |
| A-31 | —$OCH(CH_3)_2$ | " | " |
| A-32 | —Cl | " | " |
| A-33 | —$OC_2H_5$ | " | " |
| A-34 | —$OC_2H_4OCH_3$ | " | —$CH_2CH_2OCH_3$ |
| A-35 | —$NHCOCH_3$ | " | —$CH_2CH_2CH_2OH$ |
| A-36 | —$OC_2H_4OH$ | " | —$CH_2CH_2OH$ |

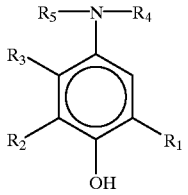

| No. | $R_1$ | $R_2$ | $R_3$ | $R_4$ | $R_5$ |
|---|---|---|---|---|---|
| A-37 | —$NHCOCH_3$ | —H | —H | —$CH_2CH_2CH_2OH$ | —$CH_2CH_2CH_2OH$ |
| A-38 | —$OCH_3$ | " | " | " | " |
| A-39 | " | —$OCH_3$ | " | " | " |
| A-40 | —H | —H | " | " | " |
| A-41 | " | " | —$CH_3$ | " | " |
| A-42 | —$OC_3H_6OH$ | " | —H | —$CH_3$ | —$CH_2CH_2CH_2OH$ |
| A-43 | —$OCH_3$ | " | " | " | " |
| A-44 | —$NHCOCH_3$ | " | " | " | " |
| A-45 | —$NHCONH_2$ | " | " | " | —$CH_2CH_2CH_2CH_2OH$ |
| A-46 | —$NHSO_2CH_3$ | " | " | " | " |
| A-47 | —$OC_2H_4OCH_3$ | " | " | " | " |
| A-48 | —$O-CH(CH_3)_2$ | " | " | —$CH_2CH_2CH_2CH_2OH$ | —$CH_2CH_2CH_2CH_2OH$ |

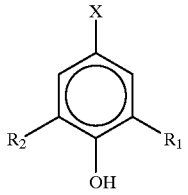

-continued
| No. | $R_1$ | $R_2$ | X |
|---|---|---|---|
| A-49 | —H | —H | 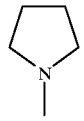 — |
| A-50 | —$OCH_3$ | " | " |
| A-51 | —$OCH_3$ | —$OCH_3$ | 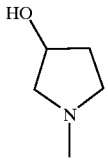 |
| A-52 | —$NHCONHCH_3$ | —H | 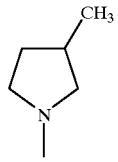 — |
| A-53 | —$OCH_2CH_2OCH_3$ | —H | 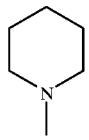 — |
| A-54 | —$NHSO_2CH_3$ | —H | 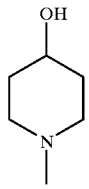 — |
| A-55 | —H | —H | 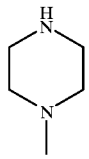 — |
| A-56 | —$OCH_3$ | " | 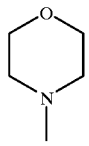 " |
| A-57 | " | " | 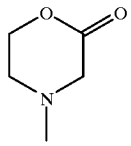 " |

-continued
| | | | |
|---|---|---|---|
| A-58 | —$OC_3H_6OH$ | " | 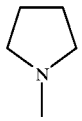 " |
| A-59 | —$CH_2OH$ | —$CH_2OH$ | " |
| A-60 | —H | —H | 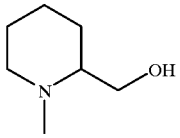 — |
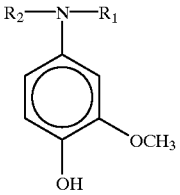
| No. | $R_1$ | $R_2$ |
|---|---|---|
| A-61 | —$CH_3$ | 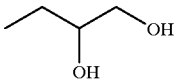 |
| A-62 | 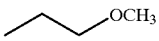 | 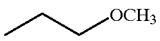 |
| A-63 | 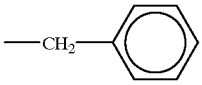 | 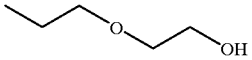 |
| A-64 | —$CH_3$ | 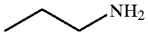 |
| A-65 | —$CH_3$ | 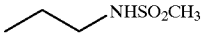 |
| A-66 | 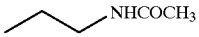 | 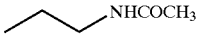 |
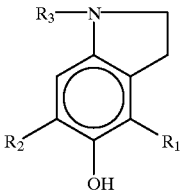
| No. | $R_1$ | $R_2$ | $R_3$ |
|---|---|---|---|
| A-67 | —H | —H | 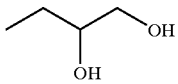 — |

-continued
| | | | |
|---|---|---|---|
| A-68 | —$OCH_3$ | " | " |
| A-69 | —$NHCONH_2$ | " | " |
| A-70 | —$NHSO_2CH_3$ | " | 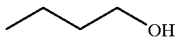 " |
| A-71 | —$OCH_3$ | —$OCH_3$ | 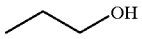 |
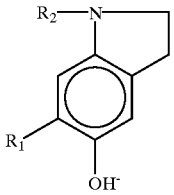
| No. | $R_1$ | $R_2$ |
|---|---|---|
| A-72 | —H | 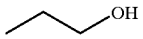 — |
| A-73 | —$OCH_3$ | " |
| A-74 | —H | 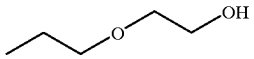 — |
| A-75 | —$OCH_3$ | " |
| A-76 | —H | 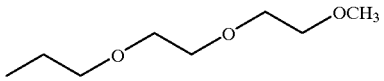 — |
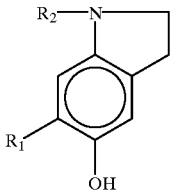
| No. | $R_1$ | $R_2$ |
|---|---|---|
| A-77 | —H | 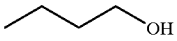 — |
| A-78 | 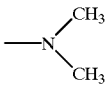 | " |
| A-79 | 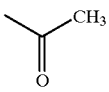 | " |
| A-80 | —$CO_2H$ | —$CH_3$ |

-continued
A-81
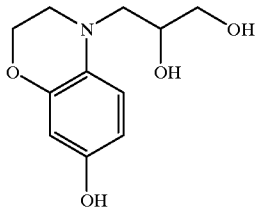
A-82
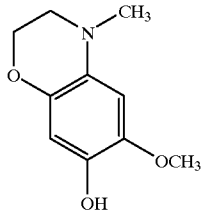
A-83
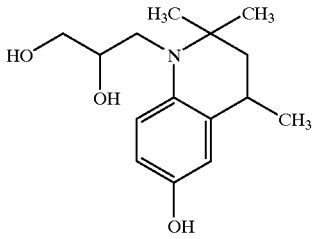
A-84
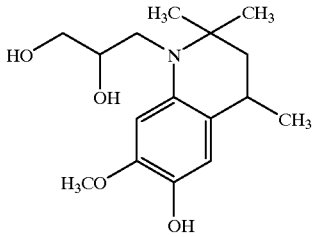
A-85
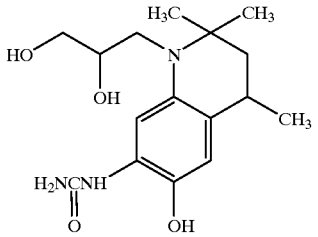
A-86
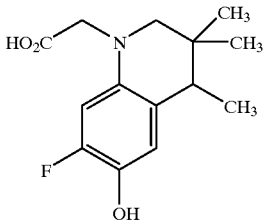

-continued
A-87
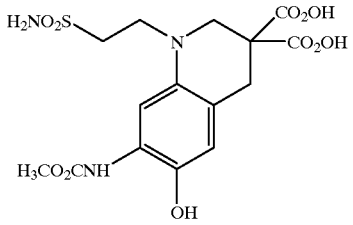
A-88
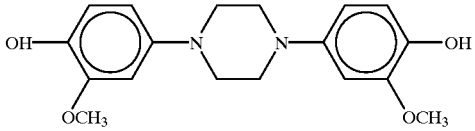
A-89
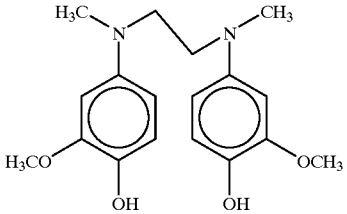
A-90
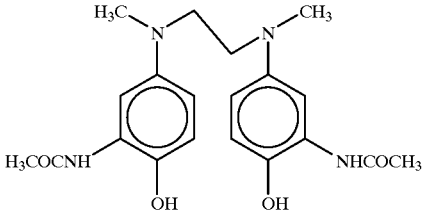
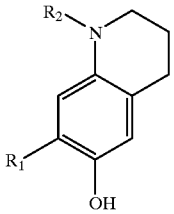
| No. | $R_1$ | $R_2$ |
|---|---|---|
| A-91 | —$OCH_3$ | —$CH_3$ |
| A-92 | —H | 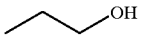 — |
| A-93 | " | 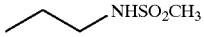 " |
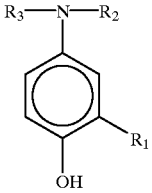
| No. | $R_1$ | $R_2$ | $R_3$ |
|---|---|---|---|

-continued

| | | | |
|---|---|---|---|
| A-94 | —SH | 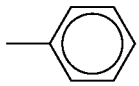 — | 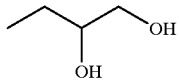 — |
| A-95 | —$SCH_3$ | —$CH_3$ | —$C_3H_6$—OH |
| A-96 | —$COOCH_3$ | 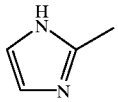 | " |
| A-97 | —$CONH_2$ | 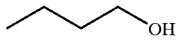 | " |
| A-98 | 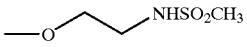 | —$CH_3$ | " |
| A-99 | —$CH_2OH$ | " | —$CH_3$ |
| A-100 | 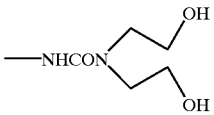 | " | " |
| A-101 | —H | 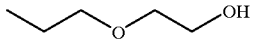 — | 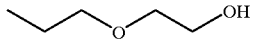 — |
| A-102 | —$OCH_2$ | " | " |
| A-103 | —$COCH_2$ | —$CH_3$ | —$CH_3$ |
| A-104 | —$CONH_2$ | " | " |
| A-105 | 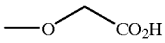 | " | " |

The compound represented by formula (II) is added in the developing solution generally in an amount of from 0.0005 to 0.2 mol/liter, preferably from 0.003 to 0.1 mol/liter.

The compounds represented by formula (A) can be easily synthesized based on the general synthesis methods described, for example, in *Photographic Science and Engineering*, 10, 306 (1966), or the synthesis examples described in Japanese Patent Application No. 8-70908.

The preservatives used in the present invention include sodium sulfite, potassium sulfite, lithium sulfite, ammonium sulfite, sodium bisulfite, potassium metabisulfite and sodium formaldehydebisulfite. The sulfites are preferably added in an amount of 0.1 mol/liter or less, and more preferably in an amount of 0.05 mol/liter or less, because the addition of large amounts of sulfites causes silver stain in the developing solution.

Additives for use in the present invention, other than those described above, include development inhibitors such as sodium bromide and potassium bromide; organic solvents such as ethylene glycol, diethylene glycol, triethylene glycol and dimethylformamide; development accelerators such as alkanolamines such as diethanolamine and triethanolamine, and imidazole or derivatives thereof; and antifoggants or black pepper inhibitors such as mercapto compounds, indazole compounds, benzotriazole compounds and benzoimidazole compounds, specific examples of which include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2-yl)thio]butanesulfonate, 5-amino-1,3,4-thiadiazole-2-thiol, methylbenzotriazole, 5-methylbenzotriazole and 2-mercaptobenzotriazole. The use amount of the antifoggant is usually 0.01 to 10 mmol, and more preferably 0.1 to 2 mmol, per liter of developing solution.

Further, in the developing solutions used in the present invention, various kinds of organic and inorganic chelating agents can be used alone or in combination. Sodium tetrapolyphosphate and sodium hexametaphosphate can be used as the inorganic chelating agents.

On the other hand, organic carboxylic acids, aminopolycarboxylic acids, organic sulfonic acids, aminosulfonic acids and organic phosphonocarboxylic acids can be mainly used as the organic chelating agents.

The organic carboxylic acids include acrylic acid, oxalic acid, malonic acid, succinic acid, glutaric acid, adipic acid, pimelic acid, azelaic acid, sebacic acid, nonane-dicarboxylic acid, decanedicarboxylic acid, undecane-dicarboxylic acid, maleic acid, itaconic acid, malic acid, citric acid and tartaric acid.

The aminopolycarboxylic acids include iminodiacetic acid, nitrilotriacetic acid, nitrilotripropionic acid, ethylenediaminemonohydroxyethyltriacetic acid, ethylenediaminetetra-acetic acid, glycolethertetraacetic acid, 1,2-diaminopropane-tetraacetic acid, diethylenetriaminepentaacetic acid, triethylenetetraminehexaacetic acid, 1,3-diamino-2-propanol-tetraacetic acid, glycoletherdiaminetetraacetic acid and compounds described in JP-A-52-25632, JP-A-55-67747, JP-A-57-102624 and JP-B-53-40900.

The organic phosphonic acids include hydroxyalkylidenediphosphonic acids described in U.S. Pat. Nos. 3,214,454 and 3,794,591 and West German Patent (OLS) 2,227,396, and compounds described in *Research Disclosure*, 181, Item 18170 (May, 1979).

The aminophosphonic acids include compounds described in *Research Disclosure*, 18170 described above, JP-A-57-208554, JP-A-54-61125, JP-A-55-29883 and JP-A-56-97347, as well as aminotris(methylenephosphonic acid), ethylenediaminetetra-methylenephosphonic acid and aminotrimethylenephosphonic acid.

The organic phosphonocarboxylic acids include compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, 18170 described above.

These chelating agents may be used in the form of alkali metal salts or ammonium salts. The amount of these chelating agents added is preferably $1\times10^{-4}$ to $1\times10^{-1}$ mol, and more preferably $1\times10^{-3}$ to $1\times10^{-2}$ mol, per liter of developing solution.

Further, compounds described in JP-A-56-24347, JP-B-56-45685, JP-B-62-2849 and JP-A-4-362942 can be used in the developing solutions as silver stain inhibitors.

Furthermore, compounds described in JP-A-62-212651 can be used as developing unevenness inhibitors, and compounds described in JP-A-61-267759 can be used as auxiliary solvents.

The developing solutions may further contain color toning agents, surfactants, antifoaming agents and hardening agents as so desired.

The processing temperature and time are related to each other, and determined with reference to the whole processing time. The processing temperature is generally about 20° C. to about 50° C., and preferably 25° C. to 45° C., and the processing time is 5 seconds to 2 minutes, and preferably 7 seconds to 1 minute and 30 seconds.

In the present invention, it is preferred that a developing start solution and a developing replenisher each has the property that "when 0.1 mol of acetic acid is added to 1 liter of the solution, a decrease in pH is 0.3 or less". In a method for confirming that the developing start solution or the developing replenisher to be used has this property, the pH of the developing start solution or the developing replenisher to be tested is adjusted to 10.0, then, 0.1 mol of acetic acid is added to 1 liter of the solution, and the pH value of the solution at this time is measured. When a decrease in pH value is 0.3 or less, the solution is judged to have the property defined above. In the present invention, the developing start solution and the developing replenisher each having a decrease in pH value of 0.25 or less in the above-mentioned test are preferably used.

As a method for giving the above-mentioned property to the developing start solution and the developing replenisher, the use of buffers is preferred. The buffers used herein include carbonates, boric acid described in JP-A-62-186259, saccharides (for example, saccharose) described in JP-A-60-93433, oximes (for example, acetoxime), phenols (for example, 5-sulfosalicylic acid) and tertiary phosphates (for example, sodium salts and potassium salts), and the carbonates and boric acid are preferably used. The buffers, particularly the carbonates, are used preferably in an amount of 0.3 mol/liter or more, and more preferably in an amount of 0.5 to 1.5 mol/liter.

In the present invention, the pH of the developing start solution is from 9.0 to 10.5, and preferably ranges from 9.5 to 10.0. The pH of the developing replenisher and that of the developing solution in a developing tank in continuous processing is also within this range.

As the alkali agents used for the pH adjustment, ordinary water-soluble inorganic alkali metal salts (for example, sodium hydroxide, potassium hydroxide, sodium carbonate and potassium carbonate) can be used.

When one meter square of a silver halide light-sensitive material is processed, the replenisher volume of the developing solution is generally 350 ml or less, preferably 180 ml to 30 ml, and particularly 100 ml to 50 ml.

The developing replenisher may have the same composition as that of the developing start solution, or may have a higher concentration than the start solution for components consumed in development. In the present invention, the pH of the developing solution decreases with the processing of the light-sensitive material. It is therefore preferred that the pH of the developing replenisher is established to a value higher than that of the developing start solution. Specifically, the pH of the developing replenisher is established preferably 0.05 to 1.0 higher, more preferably 0.3 to 0.7 higher than that of the developing start solution.

For the purpose of reducing transport costs of processing solutions, packaging material costs and space, it is preferred that the processing solutions are concentrated, and diluted at the time of use.

As a fixing agent of a fixing solution for use in the present invention, ammonium thiosulfate, sodium thiosulfate and ammonium sodium thiosulfate can be used. The amount of the fixing agent used can be appropriately changed, but it is generally about 0.7 to about 3.0 mol/liter.

The fixing solution for use in the present invention may contain water-soluble aluminum salts or water-soluble chromium salts acting as hardening agents, and the water-soluble aluminum salts are preferred. Examples thereof include aluminum chloride, aluminum sulfate, potassium alum, ammonium aluminum sulfate, aluminum nitrate and aluminum lactate. It is preferred that these are contained in an amount of 0.01 to 0.15 mol/liter as the aluminum ion concentration in working solutions.

When the fixing solution is preserved as a concentrated solution or a solid agent, they may be composed of a plurality of parts, separating the hardeners and the like as other parts, or may be a one-part solution containing all components.

The fixing solutions can contain preservatives (for example, 0.015 mol/liter or more, preferably 0.02 mol/liter to 0.3 mol/liter of sulfites, bisulfites or metabisulfites), pH buffers (for example, 0.1 mol/liter to 1 mol/liter, preferably 0.2 mol/liter to 0.7 mol/liter of acetic acid, sodium acetate, sodium carbonate, sodium hydrogencarbonate, phosphoric acid, succinic acid or adipic acid) and compounds having aluminum-stabilizing ability or water-softening ability (for example, 0.001 mol/liter to 0.5 mol/liter, preferably 0.005 mol/liter to 0.3 mol/liter of gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives or salts thereof, saccharides or boric acid), if desired.

In addition, the fixing solution can contain compounds described in JP-A-62-78551, pH regulators (for example, sodium hydroxide, ammonium and sulfuric acid), surfactants, wetting agents and fixing accelerators. The surfactants include, for example, anionic surfactants such as sulfates and sulfonates, polyethylene surfactants and amphoteric surfactants described in JP-A-57-6840, and known antifoaming agents can also be used. The wetting agents include alkanolamines and alkylene glycols. The fixing accelerators include alkyl- and allyl-substituted thiosulfonic acids and salts thereof described in JP-A-6-308681, thiourea derivatives described in JP-B-45-35754, JP-B-58-122535 and JP-B-58-122536, alcohols having triple bonds in their molecules, thioether compounds described in U.S. Pat. No. 4,126,459, mercapto compounds described in JP-A-64-4739, JP-A-1-4739, JP-A-1-159645 and JP-A-3-101728, mesoionic compounds described in JP-A-4-170539, and thiocyanates.

The fixing solution for use in the present invention has a pH of 4.0 or more, preferably 4.5 to 6.0. The fixing solutions are contaminated with the developing solution by processing to increase the pH. In this case, the pH is 6.0 or less and preferably 5.7 or less for hardening fixing solutions, and the pH is 7.0 or less and preferably 6.7 or less for non-hardening fixing solutions.

The replenishment rate of the fixing solution is 400 ml or less, preferably 320 ml or less, and more preferably 50 ml to 200 ml, per $m^2$ of light-sensitive material. The replenisher may have the same composition and/or concentration as the start solution, or may have a composition and/or a concentration different therefrom.

The fixing solutions can be regenerated by known regeneration methods of fixing solutions such as electrolytic silver recovery, followed by the use of them. Regeneration devices include, for example, an FS 8000 device manufactured by Fuji Photo Film Co., Ltd.

Further, it is also preferred that an adsorption filter such as activated carbon is used to eliminate a dye and the like.

The light-sensitive materials which have been developed and fixed are then subjected to washing or stabilization processing (unless otherwise specified, the term "washing" hereinafter include "stabilization processing", and a solution used therefor is referred to as "water" or "washing water"). Water used for washing may be tap water, ion-exchanged water, distilled water or stabilized water. The replenishment rate thereof is generally about 8 liters to about 17 liters per $m^2$ of light-sensitive material, but washing can also be conducted at a replenishment rate of less than that. In particular, washing at a replenishment rate of 3 liters or less (including 0, namely pool washing) not only makes water-saving processing possible, but also can make piping for installation of an automatic processor unnecessary. When washing is carried out at a low replenishment rate, it is more preferred that washing tanks having squeeze rolls or cross-over rolls described in JP-A-63-18350 and JP-A-62-287252 are provided. In order to reduce environmental pollution load which raises a problem in washing with a small amount of water, and to prevent water scale, addition of various oxidizing agents (for example, ozone, hydrogen peroxide, sodium hypochlorite, active halogen, chlorine dioxide and sodium carbonate peroxyhydrate) and filtration through filters may be combined therewith.

As a method for decreasing the replenishment rate of washing water, a multi-stage countercurrent system (for example, two-stage or three-stage) has been known for long, and the replenishment rate of washing water is preferably 50 to 200 ml/$m^2$ of light-sensitive material. This effect is also similarly obtained by an independent multi-stage system (a method for replenishing a fresh solution to multi-stage washing tanks, separately, without use of countercurrent replenishment.

Further, water scale prevention means may be applied to a washing stage in the present invention. As the water scale prevention means, known means can be used, and there is no particular limitation thereon. Examples thereof include methods of adding antifungal agents (so-called water scale inhibitors), methods of passing electric currents, methods of irradiating ultraviolet rays, infrared rays or far infrared rays, methods of applying electromagnetic fields, methods of treating with ultrasonic waves, methods of applying heat and methods of making tanks empty at the time of nonuse. These water scale prevention means may be applied according to the processing of the light-sensitive materials, or at certain intervals, regardless of the conditions of use, or only for periods in which the processing is not conducted, for example, at night. Further, washing water previously subjected to the water scale prevention means may be replenished. It is also preferred for prevention of generation of resistant bacteria that different water scale prevention means are applied for every definite period.

There is no particular limitation on the antifungal agents, and known ones can be used. Examples thereof include chelating agents such as glutaraldehyde and aminopolycarboxylic acid, cationic surfactants and mercaptopyridine oxide (for example, 2-mercaptopyridine-N-oxide), as well as the above-mentioned oxidizing agents. They may be used alone or in combination.

As the methods for passing electric currents, methods described in JP-A-3-224685, JP-A-3-224687, JP-A-4-16280 and JP-A-4-18980 can be used.

In addition, for preventing water bubble spots or transfer of stains, known water-soluble surfactants or antifoaming agents may be added. In order to prevent contamination caused by dyes eluted from the light-sensitive materials, dye adsorbents described in JP-A-63-163456 may be added to washing systems.

An overflowed solution from the washing stage can also be partly or wholly mixed with a processing solution having fixing ability to use the mixed solution, as described in JP-A-60-235133. It is also preferred from the view point of natural environmental protection that the overflowed solution is drained after decreases in biological oxygen demand (BOD), chemical oxygen demand (COD) and iodine demand by biological treatments (for example, treatments with sulfur-oxidizing bacteria or activated sludge, or treatments with filters in which microorganisms are carried on porous carriers such as activated carbon and ceramics) or by oxidation treatments by electric current passing or with oxidizing agents, or that the concentration of silver contained in drainage is reduced by filtering out silver through filters using polymers having affinity for silver or by adding compounds forming slightly soluble silver complexes such as trimercaptotriazine to precipitate silver and filtering out the precipitates.

Further, the washing processing is followed by stabilization processing in some cases. As an example thereof, baths containing compounds described in JP-A-2-201357, JP-A-2-132435, JP-A-1-102553 and JP-A-46-44446 may be used as final baths for the light-sensitive materials. Ammonium compounds, compounds of metals such as Bi and Al, fluorescent whitening agents, various chelating agents, membrane pH regulators, hardening agents, disinfectants, antifungal agents, alkanolamines or surfactants can also be added to these stabilizing baths if necessary.

Additives such as the antifungal agents added to the washing and stabilizing baths, and stabilizing agents can also be used as solid agents similarly with the above-mentioned developing and fixing processing agents.

Waste liquids of the developing solutions, the fixing solutions, washing water and the stabilizing solutions used in the present invention are preferably burned to dispose them. It is also possible to concentrate or solidify these waste liquids with a concentrating device as described in JP-B-7-83867 and U.S. Pat. No. 5,439,560, followed by disposition.

When the replenishment rate is reduced, it is preferred to prevent evaporation and air oxidation of the solution by decreasing the opening area of the processing tank. Roller transfer type automatic processors are described in U.S. Pat. Nos. 3,025,779 and 3,545,971, and briefly referred to as roller transfer type automatic processors in this specification. This automatic processor comprises the four stages of development, fixing, washing and drying. It is most preferred that the methods used in the present invention also follow these four stages, although not excluding another stage (for example, a stop stage). Further, a rinsing bath may be provided between development and fixing, and/or between fixing and washing.

In the present invention, the development processing is preferably conducted for 25 seconds to 160 seconds at dry to dry. The developing and fixing time is 40 seconds or less, and preferably 6 seconds to 35 seconds, and the temperature of each solution is preferably 25° C. to 50° C., and more preferably 30° C. to 40° C. The temperature and the time of washing are preferably 0° C. to 50° C. and 40 seconds or less, respectively. According to the present invention, the light-sensitive materials which have been developed, fixed and washed may be squeezed to remove washing water, namely, they may be passed between squeeze rolls, followed by drying. The drying is carried out at about 40° C. to about 100° C., and the drying time can be appropriately varied according to the environmental conditions. Any of known drying methods can be used, and there is no particular limitation thereon. Examples thereof include hot air drying, heat roller drying described in JP-A-4-15534, JP-A-5-2256 and JP-A-5-289294, and drying by far infrared rays, and the plural methods may be used in combination.

When the developing processing agents and the fixing processing agents used in the present invention are liquid agents, they are preferably stored in wrapping up in packaging materials having a low oxygen permeability as described, for example, in JP-A-61-73147. Further, when these solutions are concentrated solutions, they are diluted with water to give a specified concentration at the time of use, for example, at a rate of 0.2 to 3 parts of water per part of concentrated solution.

The developing processing agents and the fixing processing agents used in the present invention provide results similar to those of the liquid agents, also in the solid form, and solid processing agents are described below.

The solid processing agents used in the present invention can be employed in known forms (such as powdery, granular, massive, tablet, compactor, briquette, tabular, rod-like and paste-like forms). In order to separate components reacting with each other in contact, the components may be coated with water-soluble coating agents or films, or may be formed in plural-layer constitution to separate the components reacting with each other, or these may be used in combination.

Known compounds can be used as coating agents and granulating auxiliaries., and polyvinylpyrrolidone, polyethylene glycol, polystyrenesulfonic acid and vinyl compounds are preferred. In addition, reference can be made to JP-A-5-45805, column 2, line 48 to column 3, line 13.

In the case of the plural-layer constitution, a component which does not react even in contact may be put between components which react with each other to form a plural-layered product, which may be processed to tablets or briquettes, or components of known forms may be formed to similar layer constitution, which may be wrapped. These methods are described, for example, in JP-A-61-259921, JP-A-4-16841, JP-A-4-78848 and JP-A-5-93991.

The bulk density of the solid processing agent is preferably 0.5 to 6.0 g/cm$^3$. In particular, it is preferably 1.0 to 5.0 g/cm$^3$ for the tablets, and 0.5 to 1.5 g/cm$^3$ for the granules.

As methods for producing the solid processing agents in the present invention, any of known methods can be used. For example, reference can be made to JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605 and JP-A-8-286329.

More specifically, rolling granulation, extrusion granulation, compression granulation, pulverization granulation, stirring granulation, spray drying, dissolution coagulation, briquetting and roller compacting can be used.

The solid processing agents used in the present invention can also be controlled in solubility by changing the surface conditions (such as smoothness and porousness), partially changing the thickness, or forming them into the hollow doughnut shape. Further, in order to give different solubilities to a plurality of granulated products or to match the solubility of materials different in solubility, it is also possible to take a plurality of forms. A multilayer granulated product may also be used in which a surface thereof is different from the inside thereof in composition.

As the packaging materials for the solid processing agents, materials low in oxygen permeability and moisture permeability are preferred, and known forms such as bag-like, cylindrical and box-like forms can be used for the packaging materials. Collapsible forms as disclosed in JP-A-6-242585 to JP-A-6-242588, JP-A-6-247432, JP-A-6-247448, JP-A-6-301189, JP-A-7-5664 and JP-A-7-5666 to JP-A-7-5669 are also preferred to decrease the space for storing waste packaging materials. These packaging materials may be provided with screw caps, pull tops or aluminum seals at outlets for the processing agents, or heat sealed. However, other known means may be used, without limitation thereto. Furthermore, it is preferable in respect to environmental protection to recycle or reuse the waste packaging materials.

There is no particular limitation on methods for dissolving and replenishing the solid processing agents used in the present invention, and known methods can be used. Examples of these methods include a method of dissolving a specified amount of the solid processing agent in a dissolving device having a stirring function and replenishing the resulting solution; a method of dissolving the solid processing agent in a dissolving device having a dissolving section and a section for stocking a completed solution, and replenishing the solution from the stocking section as described in JP-A-9-80718; a method of supplying the solid processing agent to a circulating system of an automatic processor, dissolving it, and replenishing the resulting solution as described in JP-A-5-119454, JP-A-6-19102 and JP-A-7-261357; and a method of supplying the processing agent into an automatic processor containing a dissolving tank according to the processing of a light-sensitive material, and dissolving it. However, any of other known methods can also be used. The package may be either manually opened to supply the processing agent, or automatically opened to automatically supply the processing agent with a dissolving device or an automatic processor having an opening mechanism. The latter is preferred from the viewpoint of working environment. Specifically, there are methods of breaking through, peeling off, cutting off and push cutting the outlets of the packages, and methods described in JP-A-6-19102 and JP-A-6-95331.

Hydrazine derivatives for use in the present invention are described. In the present invention, compounds of formula (I) described in JP-A-7-287355 (corresponds to U.S. Pat. No. 5,496,681) are used. Specifically, compounds of I-1 to I-53 described therein are used.

Further, the following hydrazine derivatives are also preferably used.

Namely, compounds represented by (Chemical Formula 1) described in JP-B-6-77138, specifically, compounds described on pages 3 and 4 thereof; compounds represented by formula (I) described in JP-B-6-93082, specifically, compounds 1 to 38 described on pages 8 to 18 thereof; compounds represented by formulae (4), (5) and (6) described in JP-A-6-230497, specifically, compounds 4-1 to 4-10 described on pages 25 and 26 thereof, compounds 5-1 to 5-42 described on pages 28 to 36 and compounds 6-1 to 6-7 described on pages 39 and 40; compounds represented by formulae (1) and (2) described in JP-A-6-289520, specifically, compounds 1-1) to 1-17) and 2-1) described on pages 5 to 7 thereof; compounds represented by (Chemical Formula 2) and (Chemical Formula 3) described in JP-A-6-313936, specifically, compounds described on pages 6 to 19 thereof; compounds represented by (Chemical Formula 1) described in JP-A-6-313951, specifically, compounds described on pages 3 to 5 thereof; compounds represented by formula (I) described in JP-A-7-5610, specifically, compounds I-1 to I-38 described on pages 5 to 10 thereof; compounds represented by formula (II) described in JP-A-7-77783, specifically, compounds II-1 to II-102 described on pages 10 to 27 thereof; compounds represented by formulae (H) and (Ha) described in JP-A-7-104426, specifically, compounds H-1 to H-44 described on pages 8 to 15 thereof; compounds each having an anionic group or a nonionic group forming an intermolecular hydrogen bond with a hydrogen atom of hydrazine, in the vicinity of a hydrazine group, described in JP-A-9-22082, particularly, compounds represented by formulae (A), (B), (C), (D), (E) and (F), specifically, compounds N-1 to N-30 described therein; and compounds represented by formula (1) described in JP-A-9-22082, specifically, compounds D-1 to D-55 described therein.

The preferred hydrazine derivatives used in the present invention are represented by formula (NB):

$$A\text{-}(B)_m \qquad \text{(NB)}$$

wherein A represents a connecting group, B represents a group represented by the following formula (B-1), and m represents an integer of 2 to 6:

$$\text{-}(L_2\text{—}Ar_2)_n\text{-}L_1\text{—}Ar_1\text{—NHNH—}G_1\text{—}R_1 \qquad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P($R_2$)(=O)—, —CO—CO—, a thiocarbonyl group or a iminomethylene group; and $R_2$ is selected from the same groups as defined for $R_1$ and may be different from $R_1$.

In formula (B-1), the aromatic groups represented by $Ar_1$ and $Ar_2$ are monocyclic or bicyclic aryl groups such as benzene rings or naphthalene rings. The aromatic heterocyclic groups represented by $Ar_1$ and $Ar_2$ are monocyclic or bicyclic aromatic heterocyclic groups, and may be cyclo-condensed with other aryl groups. Examples thereof include pyridine, pyrimidine, imidazole, pyrazole, quinoline, isoquinoline, benzimidazole, thiazole and benzothiazole rings.

$Ar_1$ and $Ar_2$ are preferably aromatic groups, and more preferably phenylene groups.

$Ar_1$ and $Ar_2$ may be substituted, and typical examples of the substituent groups include alkyl (including active methine), alkenyl, alkynyl, aryl, heterocyclic, quaternized nitrogen atom-containing heterocyclic, (for example, pyridinio), hydroxyl, alkoxyl (including groups repeatedly containing ethyleneoxy group or propyleneoxy group units), aryloxy, acyloxy, acyl, alkoxycarbonyl, aryloxycarbonyl, carbamoyl, urethane, carboxyl (including salts thereof), imido, amino, carbonamido, sulfonamido, ureido, thioureido, sulfamoylamino, semicarbazido, thiosemicarbazido, hydrazino, quaternary ammonio, mercapto, (alkyl, aryl or heterocyclic) thio, (alkyl or aryl) sulfonyl, (alkyl or aryl)sulfonyl, sulfo (including salts thereof), sulfamoyl, acylsulfamoyl, (alkyl or aryl) sulfonylureido, (alkyl or aryl)sulfonylcarbamoyl, halogen atoms, cyano, nitro, phosphoric acid amido, groups each having a phosphoric ester structure, acylureido, selenium or tellurium atom-containing groups, groups each having a tertiary or quaternary sulfonium structure and quaternized phosphorus atom-containing groups. These substituent groups may be further substituted by these substituent groups.

Preferred examples of the substituent groups include alkyl having 1 to 20 carbon atoms, aralkyl, heterocyclic, substituted amino, acylamino, sulfonamido, ureido, sulfamoylamino, imido, thioureido, phosphoric acid amido, hydroxyl, alkoxyl, aryloxy, acyloxy, acyl, alkoxycarbonyl, aryloxycarbonyl, carbamoyl, carboxyl (including salts thereof), (alkyl, aryl or heterocyclic) thio, sulfo (including salts thereof), sulfamoyl, halogen atoms, cyano and nitro.

$Ar_1$ is preferably an unsubstituted phenylene group.

In formula (B-1), the alkyl group represented by $R_1$ is preferably an alkyl group having 1 to 10 carbon atoms, and the aryl group is preferably a monocyclic or bicyclic aryl group, for example, a group containing a benzene ring.

The heterocyclic group is a 5- or 6-membered ring compound containing at least one of nitrogen, oxygen and sulfur atoms. Examples thereof include imidazolyl, pyrazolyl, triazolyl, tetrazolyl, pyridyl, pyridinio, quinolinio and quinolinyl. Pyridyl and pyridinio are particularly preferred.

The alkoxyl group is preferably an alkoxyl group having 1 to 8 carbon atoms, and the aryloxy group is preferably a monocyclic group. The amino group is preferably an unsubstituted amino group, or an alkylamino, arylamino or substituted or unsubstituted heterocyclic amino group having 1 to 10 carbon atoms.

$R_1$ may be substituted, and the preferred substituent groups are the same as shown as the substituent groups for $Ar_1$ and $Ar_2$.

Of the groups represented by $R_1$, when $G_1$ is a —CO— group, a preferred group is a hydrogen atom, an alkyl group (for example, methyl, trifluoromethyl, difluoromethyl, 2-carboxytetrafluoroethyl, pyridiniomethyl, 3-hydroxypropyl, 3-methanesulfonamidopropyl or phenylsulfonylmethyl), an aralkyl group (for example, o-hydroxybenzyl) or an aryl group (for example, phenyl, 3,5-dichlorophenyl, o-methanesulfonamido-phenyl, o-carbamoylphenyl, 4-cyanophenyl or 2-hydroxymethyl-phenyl). In particular, a hydrogen atom and an alkyl group are preferred.

When $G_1$ is an —$SO_2$— group, $R_1$ is preferably an alkyl group (for example, methyl), an aralkyl group (for example, o-hydroxybenzyl), an aryl group (for example, phenyl) or a substituted amino group (for example, dimethylamino).

When $G_1$ is a —COCO— group, $R_1$ is preferably an alkoxyl group, an aryloxy group or an amino group. In particular, an alkylamino group, an arylamino group or a heterocyclic amino group (including a quaternized nitrogen atom-containing heterocyclic group) is preferred. Examples thereof include 2,2,6,6-tetramethylpiperidine-4-ylamino, propylamino, anilino, o-hydroxyanilino, 5-benzotriazolylamino and N-benzyl-3-pyridinioamino).

Further, $R_1$ may be a group which cleaves the $G_1$—$R_2$ moiety from the residual molecule to induce the cyclization reaction for forming a cyclic structure containing atoms of the —$G_1$—$R_2$ moiety, and examples thereof include groups described in JP-A-63-29751.

An adsorbent group which adsorb to a silver halide may be incorporated into the compound represented by formula (NB). Such adsorbent groups include groups such as alkylthio, arylthio, thiourea, thioamido, mercapto heterocyclic and triazole described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorbent groups to the silver halides may be precursors thereof. Such precursors include groups described in JP-A-2-285344.

In formula (B-1), the connecting groups represented by $L_1$ and $L_2$ each represents —O—, —S—, —N($R_N$)— (wherein $R_N$ represents a hydrogen atom, an alkyl group or an aryl group), —CO—, —C(═S)—, —$SO_2$—, —SO—, —P═O— or an alkylene group, which may be alone or a combination thereof. Specific examples of the combined groups include —CON($R_N$)—, —$SO_2$N($R_N$)—, —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S-alkylene group-CONH—, —O-alkylene group-CONH— and —O-alkylene group-NHCO—. These groups may be connected from either the right or the left.

When the connecting groups represented by $L_1$ and $L_2$ in formula (B-1) each contains a trivalent or more valent group, $L_1$ may connect two or more groups represented by —$Ar_1$—NHNH—$G_1$—$R_1$ in formula (B-1), and $L_2$ may connect two or more groups represented by —$Ar_2$—$L_1$—$Ar_1$—NHNH—$G_1$—$R_1$ in formula (B-1).

In this case, the trivalent or more valent connecting group contained in each of $L_1$ and $L_2$ is specifically an amino group or an alkylene group.

In formula (B-1), $L_1$ is preferably —$SO_2$NH—, —NHCONH—, —NHC(═S)NH—, —OH—, —S—, —N($R_N$)— or an active methylene group, and particularly preferably —$SO_2$NH—. $L_2$ is preferably —CON($R_N$)—, —$SO_2$N($R_N$)—, —COO—, —N($R_N$)CON($R_N$)— or —N($R_N$)CSN($R_N$)—.

The connecting group represented by A in formula (NB) is a divalent to hexavalent connecting group which can connect 2 to 6 groups represented by B, such as —O—, —S—, —N($R_N$')— (wherein $R_N$' represents a hydrogen atom, an alkyl group or an aryl group), —$N^+$($R_N$')$_2$— (wherein each $R_N$' may be the same or different, and may combine with each other to form a ring), —CO—, —C(═S)—, —$SO_2$—, —SO—, —P═O—, an alkylene group, a cycloalkylene group, an alkenylene group, an alkynylene group, an arylene group or a heterocyclic group, which may be alone, a combination thereof or a single bond. The heterocyclic group as used herein may be a heterocyclic group containing a quaternized nitrogen atom such as a pyridinio group.

The connecting group represented by A in formula (NB) may be substituted. The substituent groups include the same substituent groups as $Ar_1$ and $Ar_2$ of formula (B-1) may have.

When n is 0, the connecting group represented by A preferably contains at least one of a benzene ring, a naphthalene ring, a saturated or unsaturated heterocyclic ring, a heterocyclic ring containing a quaternized nitrogen atom such as a pyridinio group, a quaternized nitrogen atom such as an ammonio group and a cycloalkylene group.

When n is 1, the connecting group represented by A preferably contains at least one of a single bond, a benzene ring, a naphthalene ring, a saturated or unsaturated heterocyclic ring, a heterocyclic ring containing a quaternized nitrogen atom such as a pyridinio group, a quaternized nitrogen atom such as an ammonio group and a cycloalkylene group.

In formula (NB), m represents an integer from 2 to 6. It is however preferably 2, 3 or 4, and more preferably 2 or 3.

Specific examples of the compounds represented by formula (NB) are enumerated below, but the present invention is not limited thereto.

| | | R = | | | |
|---|---|---|---|---|---|
| | | —H | —$CF_2H$ | 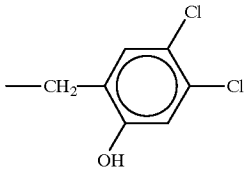 | —$CONHC_3H_7$ |
| 1 | 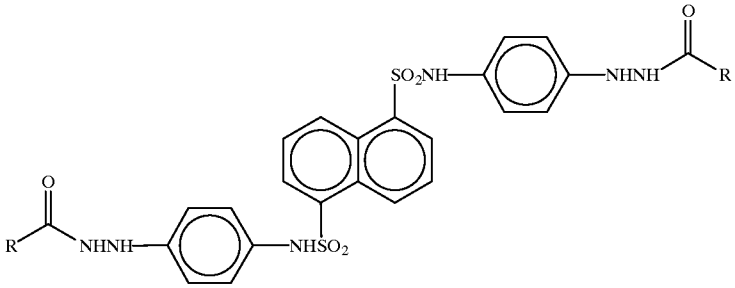 | 1a | 1e | 1k | 1l |
| 2 | 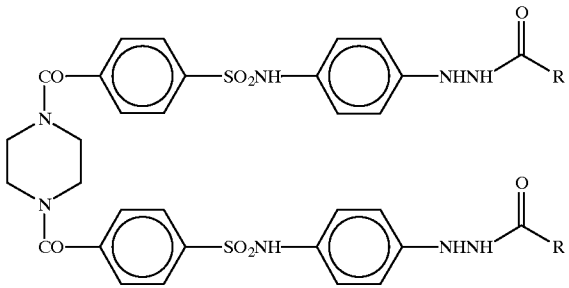 | 2a | 2e | 2k | 2l |

-continued
| | | | | | |
|---|---|---|---|---|---|
| 3 | 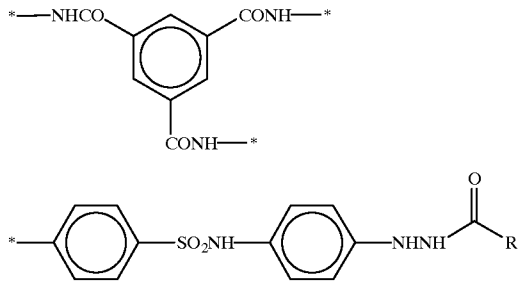 | 3a | 3e | 3k | 3l |
B = 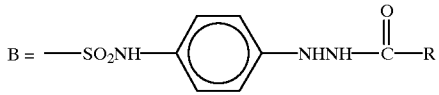
| | R = | | | |
|---|---|---|---|---|
| | —H | —$CF_2H$ | —$CF_3$ | —$CF_2SCH_3$ |
| 4 | 4a | 4e | 4c | 4r |
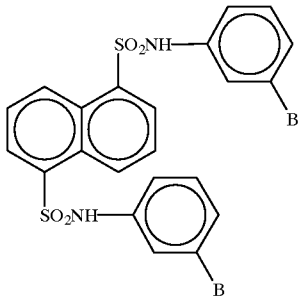

-continued
| | | | | | |
|---|---|---|---|---|---|
| 5 | 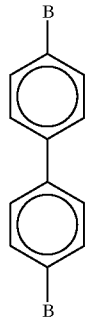 | 5a | 5e | 5c | 5r |
| 6 | 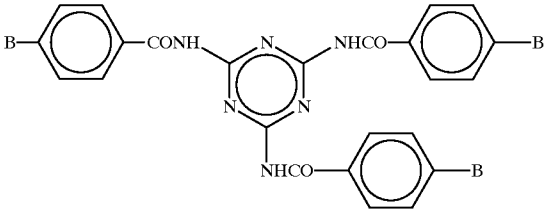 | 6a | 6e | 6c | 6r |
| 7 | 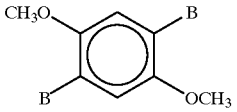 | 7a | 7e | 7c | 7r |
| 8 | 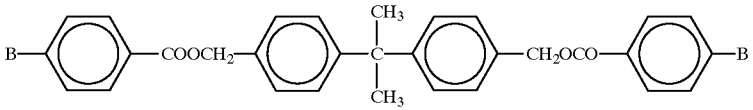 | 8a | 8e | 8c | 8r |
B = 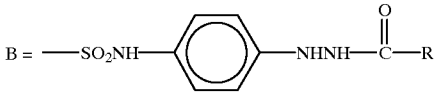
| R = | | | |
|---|---|---|---|
| —H | —$CF_2H$ | —$CONHCH_3$ | —$CF_2OCH_3$ |

-continued
| | | | | | |
|---|---|---|---|---|---|
| 9 | 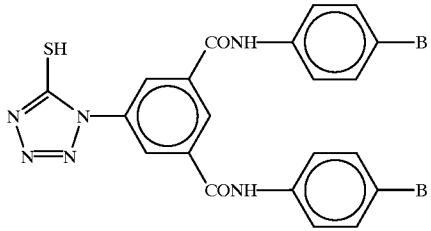 | 9a | 9e | 9p | 9b |
| 10 | 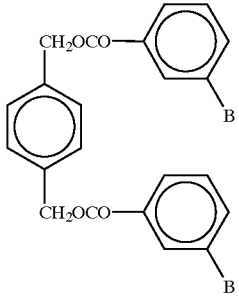 | 10a | 10e | 10p | 10b |
| R = | | | |
|---|---|---|---|
| —H | —$CF_2H$ | 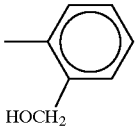 | 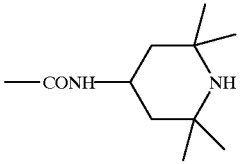 |

-continued
11
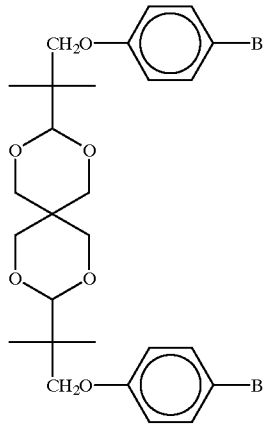
11a 11e 11f 11g
B′ =
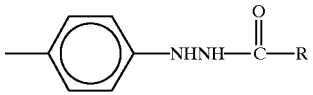
R =
—H —CF2H
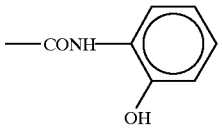
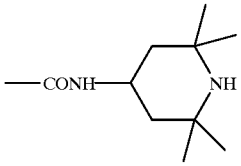
12
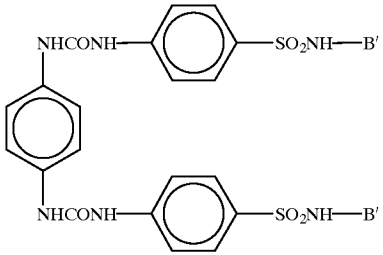
12a 12e 12s 12g -continued
| | | | | | |
|---|---|---|---|---|---|
| 13 | 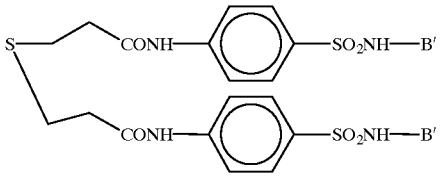 | 13a | 13e | 13s | 13g |
| 14 | 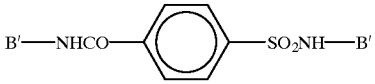 | 14a | 14e | 14s | 14g |
| 15 | 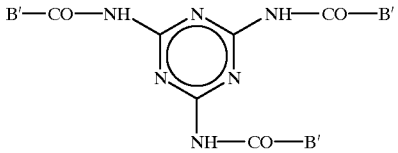 | 15a | 15e | 15s | 15g |
B′ = 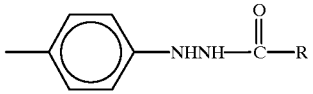
| R = | | | |
|---|---|---|---|
| —H | —$CF_2H$ | 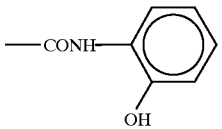 | 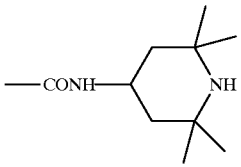 |

-continued
16
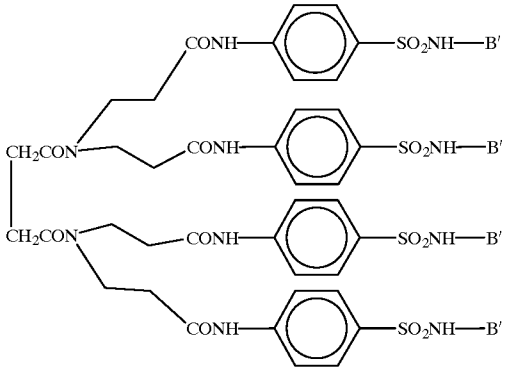
16a 16e 16s 16g
17
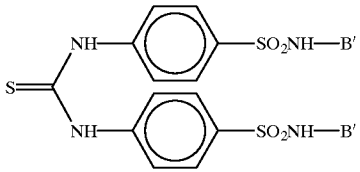
17a 17e 17s 17g
18
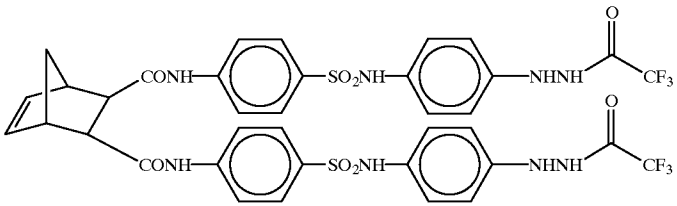
19
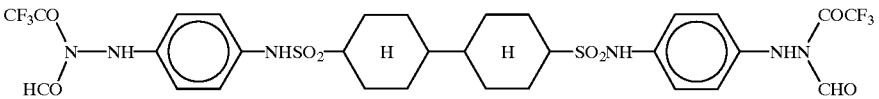
20
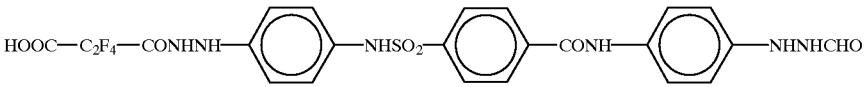

-continued
21
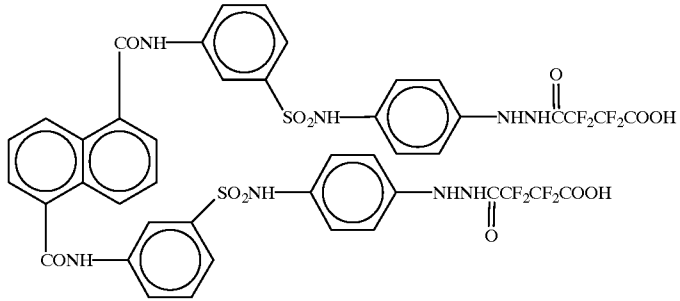
22
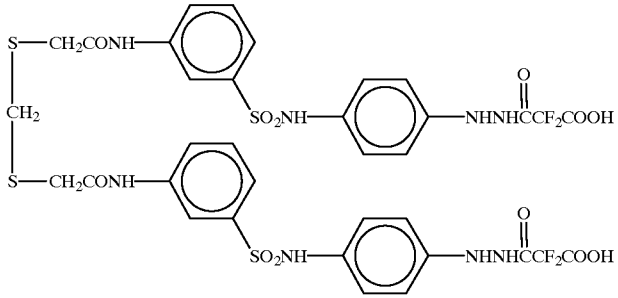
B′ =
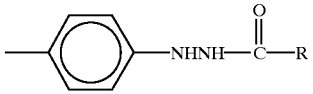
R =
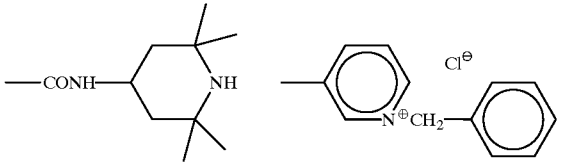
—H —$CF_3$ —$CF_2H$ -continued
| | | | | | | |
|---|---|---|---|---|---|---|
| 23 | 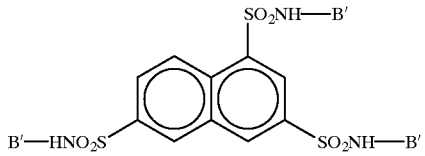 | 23a | 23c | 23e | 23g | 23d |
| 24 | 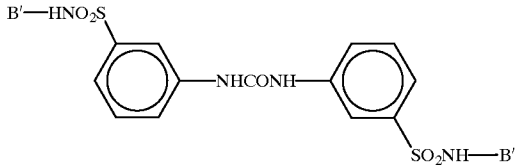 | 24a | 24c | 24e | 24g | 24d |
| 25 | 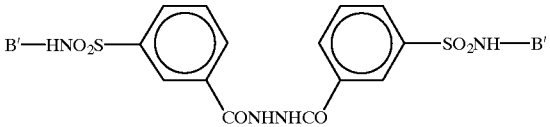 | 25a | 25c | 25e | 25g | 25d |
| 26 | 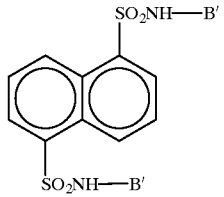 | 26a | 26c | 26e | 26g | 26d |
B′ = 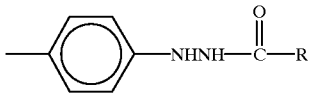
| R = | | | | | |
|---|---|---|---|---|---|
| —H | —$CF_3$ | —$CF_2H$ | —$CONHCH_3$ | 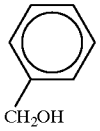 | —$C_2F_4COOH$ |

-continued
| | | | | | | | |
|---|---|---|---|---|---|---|---|
| 27 | 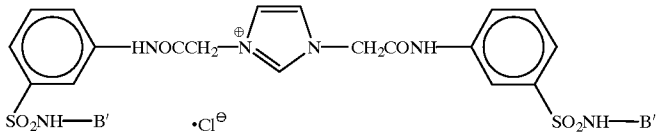 | 27a | 27c | 27e | 27p | 27f | 27t |
| 28 | 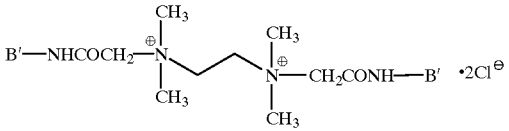 | 28a | 28c | 28e | 28p | 28f | 28t |
| 29 | 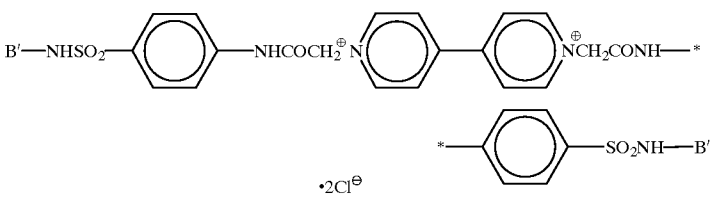 | 29a | 29c | 29e | 29p | 29f | 29t |
| 30 | 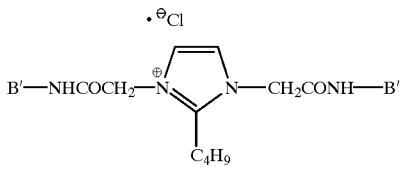 | 30a | 30c | 30e | 30p | 30f | 30t |

In the present invention, the hydrazine derivatives can be used by dissolving them in appropriate water-miscible organic solvents, for example, alcohols (such as methanol, ethanol, propanol and fluorinated alcohol), ketones (such as acetone and methyl ethyl ketone), dimethylformamide, dimethyl sulfoxide and methyl cellosolve.

Further, the hydrazine derivatives can be used by dissolving them using oils such as dibutyl phthalate, tricresyl phosphate, glyceryl triacetate and diethyl phthalate, or auxiliary solvents such as ethyl acetate and cyclohexanone by the emulsifying dispersion methods already well known to mechanically prepare emulsified dispersions. Alternatively, the hydrazine derivatives can be used by dispersing the powder thereof in water in a ball mill or a colloid mill, or with ultrasonic waves by methods known as the solid dispersion methods.

The hydrazine derivative used in the present invention may be added to any of silver halide emulsion layers on the silver halide emulsion layer side with respect to a support and other hydrophilic colloidal layers. However, the hydrazine derivative is preferably added to the silver halide emulsion layers or hydrophilic colloidal layers adjacent thereto.

In the present invention, the amount of the hydrazine derivative added is preferably $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol, per mol of silver halide.

Nucleating accelerators used in the present invention include amine derivatives, onium salts, disulfide derivatives and hydroxymethyl derivatives. Examples thereof are enumerated below:

Compounds described in JP-A-7-77783, page 48, lines 2 to 37, specifically, compounds A-1) to A-73) described on pages 49 to 58; compounds represented by (Chemical Formula 21), (Chemical Formula 22) and (Chemical Formula 23) described in JP-A-7-84331, specifically, compounds described on pages 6 to 8 thereof; compounds represented by formulae [Na] and [Nb] described in JP-A-7-104426, specifically, compounds Na-1 to Na-22 and Nb-1 to Nb-12 described on pages 16 to 20 thereof: and compounds represented by formulae (1) to (7) described in JP-A-8-272023, specifically, compounds 1-1 to 1-19, 2-1 to 2-22, 3-1 to 3-36, 4-1 to 4-5, 5-1 to 5-41, 6-1 to 6-58 and 7-1 to 7-38 described therein.

The nucleating accelerators used in the present invention can be used by dissolving them in appropriate water-miscible organic solvents, for example, alcohols (such as methanol, ethanol, propanol and fluorinated alcohol), ketones (such as acetone and methyl ethyl ketone), dimethylformamide, dimethyl sulfoxide and methyl cellosolve.

Further, the nucleating accelerators can be used by dissolving them using oils such as dibutyl phthalate, tricresyl phosphate, glyceryl triacetate and diethyl phthalate, or auxiliary solvents such as ethyl acetate and cyclohexanone by the emulsifying dispersion methods already well known to mechanically prepare emulsified dispersions. Alternatively, the nucleating accelerators can be used by dispersing the powder thereof in water in a ball mill or a colloid mill, or with ultrasonic waves by methods known as the solid dispersion methods.

The nucleating accelerator used in the present invention may be added to any of silver halide emulsion layers on the silver halide emulsion layer side with respect to a support and other hydrophilic colloidal layers. However, the nucleating accelerator is preferably added to the silver halide emulsion layers or hydrophilic colloidal layers adjacent thereto.

In the present invention, the amount of the nucleating accelerator added is preferably $1\times10^{-6}$ mol to $2\times10^{-2}$ mol, more preferably $1\times10^{-5}$ mol to $2\times10^{-2}$ mol, and most preferably $2\times10^{-5}$ mol to $1\times10^{-2}$ mol, per mol of silver halide.

Silver halide emulsions used in the present invention may contain any of silver chloride, silver bromide, silver chlorobromide, silver chloroiodobromide and silver iodobromide. However, the content of silver chloride is preferably 30 mol % or more, and more preferably 50 mol % or more. Further, the content of silver iodide is preferably 5 mol % or less, and more preferably 2 mol % or less.

Although silver halide grains may have any of the cubic, tetradecahedral, octahedral, irregular and tabular forms, the cubic or tabular form is preferred.

The light-sensitive emulsions used in the present invention can be prepared by the use of the methods described in P. Glafkides, *Chimie et Physique Photographique* (Paul Montel, 1967), G. F. Duffin, *Photoqraphic Emulsion Chemistry* (The Focal Press, 1966) and V. L. Zelikman et al., *Making and Coating Photographic Emulsion* (The Focal Press, 1964).

That is, either the acidic process or the neutral process may be employed, and a soluble silver salt and a soluble halogen salt may be reacted with each other by using any of the single jet process, the double jet process and a combination thereof.

A process in which grains are formed in the presence of excess silver ions (so-called reverse mixing process) can also be used. As a type of double jet process, a process of maintaining the pAg in a liquid phase constant in which a silver halide is formed, namely the so-called controlled double jet process, can also be used. Further, it is preferred that so-called solvents for silver halides such as ammonium, thioether and four-substituted thiourea are used to form grains. More preferably, four-substituted thiourea compounds are used, which are described in JP-A-53-82408 and JP-A-55-77737. Preferred examples of the thiourea compounds are tetramethylthiourea and 1,3-dimethyl-2-imidazolidine-thione. The amount of the solvents for silver halides added is preferably $2\times10^{-5}$ mol to $10^{-2}$ mol per mol of silver halide, although it varies depending on the desired grain size and the halogen composition.

According to the controlled double jet process and the grain forming process using the solvents for silver halides, silver halide emulsions having a regular crystal form and a narrow grain size distribution can be easily prepared. These processes are useful means for preparing the silver halide emulsions used in the present invention.

Further, in order to homogenize the grain size, it is preferred that grains are allowed to grow rapidly within the range not exceeding the critical degree of saturation by a method of changing the addition rate of silver nitrate and alkali halides depending on the growth speed of grains as described in British Patent 1,535,016, JP-B-48-36890 and JP-B-52-16364, and a method of changing the concentration of aqueous solutions as described in British Patent 4,242,445 and JP-A-55-158124.

The emulsions used in the present invention are preferably monodisperse emulsions, and the coefficient of variation thereof expressed by {(standard deviation of grain size)/(mean grain size)}×100 is preferably 20% or less, and more preferably 15% or less.

The mean grain size of the grains contained in the silver halide emulsions is preferably 0.5 μm or less, and more preferably 0.1 μm to 0.4 μm.

The silver halide emulsions used in the present invention may contain metals belonging to group VIII. In particular, light-sensitive materials suitable for high illumination exposure such as scanner exposure and light-sensitive materials for line shooting preferably contain rhodium compounds, iridium compounds, ruthenium compounds or the like in order to achieve high contrast and low fog. It is also preferable to contain iron compounds for enhancement in sensitivity.

As the rhodium compounds used in the present invention, water-soluble rhodium compounds can be used. Examples thereof include rhodium (III) halide compounds or rhodium complex salts having halogens, amines, oxalato or the like as ligands, for example, hexachlororhodium (III) complex salts, hexabromorhodium (III) complex salts, hexaaminerhodium (III) complex salts and trioxalatorhodium (III) complex salts. These rhodium compounds are used by dissolving them in water or appropriate solvents. In order to stabilize the solution of the rhodium compound, a method of adding an aqueous solution of a hydrogen halide (for example, hydrochloric acid, hydrobromic acid or hydrofluoric acid) or an alkali halide (for example, KCl, NaCl, KBr or NaBr), which is generally frequently used, can be used. Instead of use of the water-soluble rhodium, it is also possible to add and dissolve other silver halide grains previously doped with rhodium in preparing the silver halide.

The iridium compounds used in the present invention include hexachloroiridium, hexabromoiridium and hexaaminoiridium. The ruthenium compounds used in the present invention include hexachlororuthenium and pentachloronitrosylruthenium. The iron compounds used in the present invention include potassium hexacyanoferrate (III) and ferrous thiocyanate.

The amount of these compounds added is $1\times10^{-8}$ mol to $5\times10^{-6}$ mol, and preferably $5\times10^{-8}$ mol to $1\times10^{-6}$ mol, per mol of silver contained in the silver halide emulsion.

Addition of these compounds can be appropriately conducted in preparing the silver halide emulsion grains and in each stage prior to coating of the emulsions. In particular, the compounds are preferably added in forming the emulsions to incorporate them into the silver halide grains.

The silver halide emulsions used in the present invention are preferably subjected to chemical sensitization. As the chemical sensitization methods, known methods such as sulfur sensitization, selenium sensitization, tellurium sensitization and noble metal sensitization can be used alone or in combination. When they are used in combination, for example, a combination of sulfur sensitization and gold sensitization, a combination of sulfur sensitization, selenium sensitization and gold sensitization, and a combination of sulfur sensiti-zation, tellurium sensitization and gold sensitization are preferred.

The sulfur sensitization used in the present invention is usually conducted by adding a sulfur sensitizer and stirring an emulsion at a high temperature of 40° C. or more for a definite period of time. As the sulfur sensitizers, known compounds can be used. Examples thereof include various sulfur compounds such as thiosulfates, thiourea compounds, thiazole compounds and rhodanine compounds, as well as sulfur compounds contained in gelatin. Preferred sulfur compounds are thiosulfates and thiourea compounds. Although the amount of the sulfur sensitizers added varies depending on various conditions such as the pH and the temperature in chemical ripening, and the size of silver halide grains, it is $10^{-7}$ mol to $10^{-2}$ mol, and more preferably $10^{-5}$ mol to $10^{-3}$ mol, per mol of silver halide.

In the present invention, known selenium compounds can be used as selenium sensitizers. That is, the selenium sensitization is usually conducted by adding an unstable type and/or non-unstable type selenium compound and stirring an emulsion at a high temperature of 40° C. or more for a definite period of time. As the unstable type selenium compounds, compounds described in JP-B-44-15748, JP-B-43-13489, JP-A-4-25832, JP-A-4-109240 and JP-A-4-324855 can be used. In particular, compounds represented by formulae (VIII) and (IX) in JP-A-4-324855 are preferably used.

Tellurium sensitizers used in the present invention are compounds producing silver telluride presumed to form a sensitizing nucleus on a surface or in the inside of a silver halide grain. The forming rate of silver telluride in the silver halide emulsion can be tested by the method described in JP-A-5-313284.

Specifically, compounds can be used which are described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-333043 and JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), *The Chemistry of Organic Selenium and Tellurium Compounds*, vol.1, edited by S. Patai (1986) and ibid. vol. 2 (1987). In particular, compounds represented by formulae (II), (III) and (IV) in JP-A-5-313284 are preferably used.

The amount of the selenium and tellurium sensitizers used in the present invention is generally $10^{-8}$ mol to $10^{-2}$ mol, and preferably about $10^{-7}$ mol to about $10^{-3}$ mol, per mol of silver halide, although it varies depending on silver halide grains used, chemical ripening conditions and the like. There is no particular limitation on the conditions of chemical sensitization in the present invention. However, the pH is 5 to 8, the pAg is 6 to 11 and preferably 7 to 10, and the temperature is 40° C. to 95° C. and preferably 45° C. to 85° C.

Noble metal sensitizers used in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the course of formation of the silver halide grains and physical ripening, cadmium salts, sulfites, lead salts and thallium salts may be allowed to coexist with the silver halide emulsions used in the present invention.

In the present invention, reduction sensitization can be used. As reduction sensitizers, stannous salts, amines, formamidinesulfinic acid and silane compounds can be used.

Thiosulfonic acid compounds may be added to the silver halide emulsions used in the present invention by the method shown in EP-293,917.

The silver halide emulsions in the light-sensitive materials used in the present invention may be used alone or in combination (for example, emulsions different in mean grain size, emulsions different in halogen composition, emulsions different in crystal habit, and emulsions different in the conditions of chemical sensitization).

The light-sensitive silver halide emulsions used in the present invention may be spectrally sensitized to blue, green, red or infrared light having relatively long wavelengths by the use of sensitizing dyes. The sensitizing dyes which can be used include-cyanine dyes, merocyanine dyes, complex cyanine dyes, complex merocyanine dyes, holopolar cyanine dyes, styryl dyes, hemicyanine dyes, oxonol dyes and hemioxonol dyes.

The useful sensitizing dyes used in the present invention are described, for example, in *Research Disclosure*, Item 17643 IV-A, page 23 (December, 1978), ibid., Item 1831 X, page 437 (August, 1978), and literatures cited therein.

In particular, sensitizing dyes having spectral sensitivities suitable for spectral characteristics of light sources of various scanners, image setters and process cameras can be advantageously selected.

For example, the following sensitizing dyes are advantageously selected:

A) For argon laser light sources, compounds (I)-1 to (I)-8 described in JP-A-60-162247, compounds I-1 to I-28 described in JP-A-2-48653, compounds I-1 to I-13 described in JP-A-4-330434, compounds of Examples 1 to 14 described in U.S. Pat. No. 2,161,331 and compounds 1 to 7 described in West German Patent 936,071;

B) For helium-neon laser light sources, compounds I-1 to I-38 described in JP-A-54-18726, compounds I-1 to I-35 described in JP-A-6-75322 and compounds I-1 to I-34 described in JP-A-7-287338;

C) For LED light sources, dyes 1 to 20 described in JP-B-55-39818, compounds I-1 to I-37 described in JP-A-62-284343 and compounds I-1 to I-34 described in JP-A-7-287338;

D) For semiconductor laser light sources, compounds I-1 to I-12 described in JP-A-59-191032, compounds I-1 to I-22 described in JP-A-60-80841, compounds I-1 to I-29 described in JP-A-4-335342 and compounds I-1 to I-18 described in JP-A-59-192242; and E) For tungsten and xenon light sources for process cameras, compounds (1) to (19) represented by formula [I] described in JP-A-55-45015, compounds I-1 to I-97 described in Japanese Patent Application No. 7-346193 and compounds 4-A to 4-S, 5-A to 5-Q and 6-A to 6-T described in JP-A-6-242547.

These sensitizing dyes may be used alone or in combination. Combinations of the sensitizing dyes are often used particularly for supersensitization. The emulsions may contain dyes having no spectral sensitizing function for themselves, or substances which do not substantially absorb visible light and exhibit supersensitization, together with the sensitizing dyes.

The useful sensitizing dyes, the combinations of the dyes showing supersensitization, and the substances exhibiting supersensitization are described in *Research Disclosure*, 176, 17643 IV-J, page 23 (December, 1978) or JP-B-49-25500, JP-B-43-4933, JP-A-59-19032 and JP-A-59-192242 described above.

The sensitizing dyes used in the present invention may be used as a combination of two or more of them. When the sensitizing dyes are added-to the silver halide emulsions, they may be either directly dispersed in the emulsions, or added to the emulsions as solutions thereof in individual or mixed solvents. The solvents include water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Further, methods which can be used in the present invention include a method of dissolving a dye in a volatile organic solvent, dispersing the resulting solution into water or a hydrophilic colloid, and adding the resulting dispersion to an emulsion, as described in U.S. Pat. No. 3,469,987; a method of dissolving a dye in an acid, and the resulting solution is added to an emulsion, or dissolving a dye in water in the presence of an acid or a base, and adding the resulting aqueous solution to an emulsion, as described in JP-B-44-23389, JP-B-44-27555 and JP-B-57-22091; a method of dissolving or dispersing a dye into water in the presence of a surfactant, and adding the resulting aqueous solution or colloidal dispersion to an emulsion, as described in U.S. Pat. Nos. 3,822,135 and 4,006,025; a method of directly dispersing a dye into a hydrophilic colloid, and adding the resulting dispersion to an emulsion, as described in JP-A-53-102733 and JP-A-58-105141; and a method of dissolving a dye, and adding the resulting solution to an emulsion, as described in JP-A-51-74624. Further, ultrasonic waves can also be applied to the solution.

The sensitizing dyes used in the present invention may be added at any stages of the preparation of the silver halide emulsions which have hitherto been accepted to be useful. For example, they may be added at a silver halide grain formation stage and/or before salt removal, during a silver removal stage and/or from after salt removal to before the start of chemical ripening, as described in U.S. Pat. Nos. 2,735,766, 3,628,960, 4,183,756 and 4,225,666, JP-A-58-184142 and JP-A-60-196749, or at any time and stage before the coating of emulsions, such as immediately before or during chemical ripening, or from after chemical ripening to the coating of the emulsions, as described in JP-A-58-113920. Furthermore, as disclosed in U.S. Pat. No. 4,225,666 and JP-A-58-7629, the same compound may be singly added, or in combination with a compound having a different structure, divided, for example, into during a grain formation stage and during or after chemical ripening, or before or during chemical ripening and after chemical ripening. The kinds of compounds added in parts and combinations thereof may be changed.

In the present invention, the sensitizing dye can be added in an amount of $4\times10^{-6}$ mol to $8\times10^{-3}$ mol per mol of silver halide, although the amount varies depending on the shape and the size of silver halide grains, the halogen composition, the method and the degree of chemical ripening, and the kind of antifoggant. For example, when the size of silver halide grains is 0.2 $\mu$m to 1.3 $\mu$m, the sensitizing dye is added preferably in an amount of $2\times10^{-7}$ mol to $3.5\times10^{-6}$ mol, and more preferably, in an amount of $6.5\times10^{-7}$ mol to $2.0\times10^{-6}$ mol. per $m^2$ of surface area of silver halide grain.

There is no particular limitation on various additives used in the light-sensitive materials in the present invention. For example, the following compounds can be preferably used.

Polyhydroxybenzene compounds described in JP-A-3-39948, page 10, lower right column, line 11 to page 12, lower left column, line 5, specifically, compounds (III)-1 to (III)-25 described therein;

Compounds substantially not having the absorption maxima in the visible region represented by formula (I) described in JP-A-1-118832, specifically, compounds I-1 to I-26 described therein;

Antifoggants described in JP-A-2-103536, page 17, lower right column, line 19 to page 18, upper right column, line 4;

Polymer latexes described in JP-A-2-103536, page 18, lower left column, line 12 to line 20, polymer latexes having active methylene groups represented by formula (I) described in Japanese Patent Application No. 8-13592, and polymer latexes having a core/shell structure described in Japanese Patent Application No. 8-13592;

Matte agents, lubricants and plasticizers described in JP-A-2-103536, page 19, upper left column, line 15 to upper right column, line 15;

Hardening agents described in JP-A-2-103536, page 18, upper right column, line 5 to line 17;

Compounds having acid groups described in JP-A-2-103536, page 18, lower right column, line 6 to page 19, upper left column, line 1;

Conductive materials described in JP-A-2-18542, page 2, lower left column, line 13 to page 3, upper right column, line 7, specifically, metal oxides described on page 2, lower right column, line 2 to line 10 of this patent, and conductive polymers of compounds P-1 to P-7 described therein;

Water-soluble dyes described in JP-A-2-103536, page 17, lower right column, line 1 to upper right column, line 18;

Solid disperse dyes represented by formulae (FA), (FA1), (FA2) and (FA3) described in Japanese Patent Application No. 7-350753, specifically, compounds F1 to F34 described therein, compounds (II-2) to (II-24), (III-5) to (III-18) and (IV-2) to (IV-7) described in JP-A-7-152112;

Solid disperse dyes described in JP-A-2-294638 and JP-A-5-11382;

Surfactants described in JP-A-2-12236, page 9, upper right column, line 7 to lower right column, line 3. PEG surfactants described in JP-A-2-103536, page 18, lower left column, line 4 to line 7. Fluorine-containing surfactants described in JP-A-3-39948, page 12, lower left column, line 6 to page 13, lower right column, line 5, specifically, compounds VI-1 to VI-15 described therein;

Redox compounds described in JP-A-5-274816 which can release development inhibitors by oxidation, preferably, redox compounds represented by formulae (R-1), (R-2) and (R-3) described therein, specifically, compounds R-1 to R-68 described therein; and Binders described in JP-A-2-18542, page 3, lower right column, line 1 to line 20.

The present invention will be described in greater detail by reference to the following examples, but the invention should not be construed as being limited thereto.

EXAMPLE 1

Preparation of Emulsion A

| | |
|---|---|
| Solution 1 | |
| Water | 1 liter |
| Gelatin | 20 g |
| Sodium Chloride | 3.0 g |
| 1,3-Dimethyl-2-imidazolidine-2-thione | 20 mg |
| Sodium Benzenethiosulfonate | 8 mg |
| Solution 2 | |
| Water | 0.4 liter |
| Silver Nitrate | 100 g |
| Solution 3 | |
| Water | 0.4 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 6 ml |

Solution 2 and solution 3 were concurrently added to solution 1 maintained at 42° C. at pH 4.5 with stirring for 15 minutes to form nuclear grains. Subsequently, solution 4 and solution 5 were added thereto for 15 minutes, and 0.15 g of potassium iodide was further added to terminate the grain formation.

| | |
|---|---|
| Solution 4 | |
| Water | 0.4 liter |
| Silver Nitrate | 100 g |
| Solution 5 | |
| Water | 0.4 liter |
| Sodium Chloride | 27.1 g |
| Potassium Bromide | 21.0 g |
| Potassium Hexacyanoferrate (II) (0.1% aqueous solution) | 10 ml |

Then, the grains were normally washed with water by the flocculation process, and 40 g of gelatin was added thereto.

After adjustment to pH 5.7 and pAg 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to give optimum sensitivity.

Further, 100 mg of 4-hydroxy-6-methyl-1,3,3a,7-tetraazaindene was added as a stabilizer, and phenoxyethanol was added as a preservative to finally obtain cubic silver chloroiodobromide emulsion A having a mean grain size of 0.25 μm and a silver chloride content of 70 mol %.

Preparation of Coated Samples

Sensitizing dye (1) was added to emulsion A in an amount of $3.8\times10^{-4}$ mol/mol Ag, and spectral sensitization was conducted. Further, $3.4\times10^{-4}$ mol/mol Ag of KBr, $3.2\times10^{-4}$ mol/mol Ag of compound (1), $8.0\times10^{-4}$ mol/mol Ag of compound (2), $1.2\times10^{-2}$ mol/mol Ag of hydroquinone, $3.0\times10^{-3}$ mol/mol Ag of citric acid, $1.0\times10^{-4}$ mol/mol Ag of compound (3), $6.0\times10^{-4}$ mol/mol Ag of compound (4), 35% by weight based on gelatin of a polyethyl acrylate latex, 20% by weight based on gelatin of colloidal silica having a grain size of 10 μm, and 4% by weight based on gelatin of compound (5) were added thereto. Then, a polyethylene terephthalate support was coated therewith so as to give 3.7 g/m$^2$ of Ag and 1.6 g/m$^2$ of gelatin. An upper protective layer and a lower protective layer having the following compositions, respectively, were formed thereon, and an UL layer having the following composition was formed thereunder.

| | |
|---|---|
| Upper Protective Layer: | |
| Gelatin | 0.3 g/m$^2$ |
| Silica Matte Agent (mean grain size: 3.5 μm) | 25 mg/m$^2$ |
| Compound (6) (gelatin dispersion) | 20 mg/m$^2$ |
| Colloidal Silica (grain size: 10–20 μm) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |

-continued

| Lower Protective Layer: | |
|---|---|
| Gelatin | 0.5 g/m$^2$ |
| Compound (9) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer: | |
| Gelatin | 0.5 g/m$^2$ |
| Polyethyl Acrylate Latex | 150 mg/m$^2$ |
| Compound (5) | 40 mg/m$^2$ |
| Compound (10) | 10 mg/m$^2$ |

| Back Layer: | |
|---|---|
| Gelatin | 3.3 g/m$^2$ |
| Sodium Dodecylbenzenesulfonate | 80 mg/m$^2$ |
| Compound (11) | 40 mg/m$^2$ |
| Compound (12) | 20 mg/m$^2$ |
| Compound (13) | 90 mg/m$^2$ |
| 1,3-Divinylsulfonyl-2-propanol | 60 mg/m$^2$ |
| Fine Polymethyl Methacrylate Grains (mean grain size: 6.5 $\mu$m) | 30 mg/m$^2$ |
| Compound (5) | 120 mg/m$^2$ |
| Conductive Layer: | |
| Gelatin | 0.1 g/m$^2$ |
| Sodium Dodecylbenzenesulfonate | 20 mg/m$^2$ |
| $SnO_2$/Sb (weight ratio: 9/1, mean grain size: 0.25 $\mu$m) | 200 mg/m$^2$ |

The supports of the samples used in the present invention each has a back layer and a conductive layer having the following compositions, respectively:

Sensitizing Dye (1)

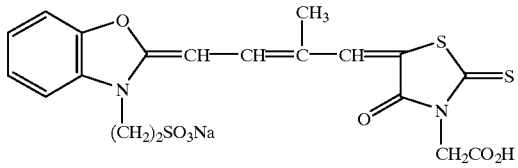

Compound (1)

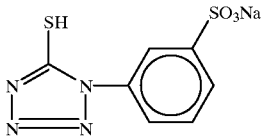

Compound (2)

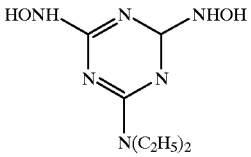

Compound (3)

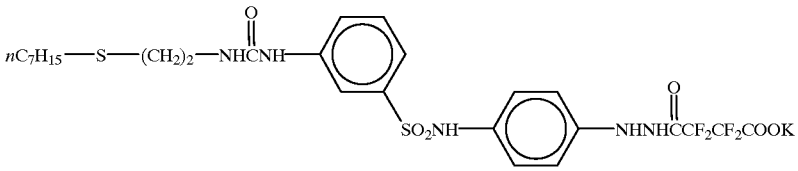

Compound (4)

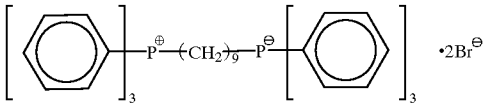

Compound (5)

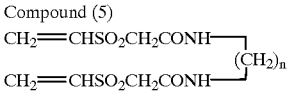

A 3:1 mixture of n=2 and n=3

-continued
Compound (6)
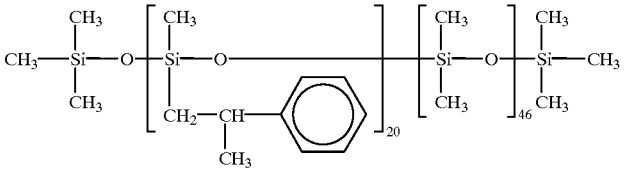
Compound (7)
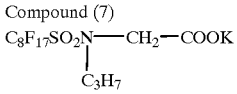
Compound (8)
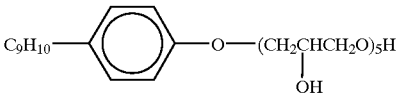
Compound (9)
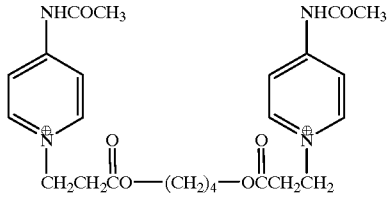
Compound (10)
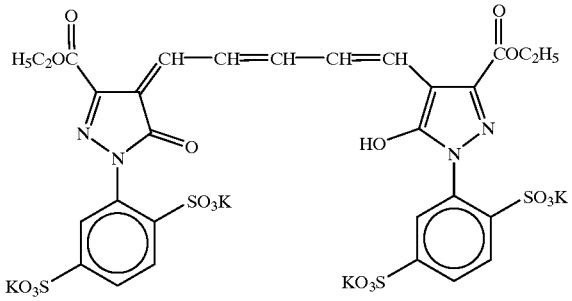
Compound (11)
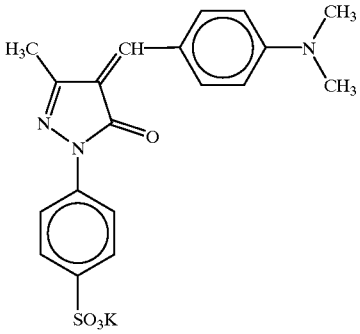
Compound (12)
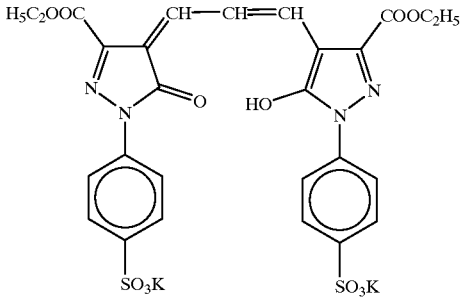

-continued

Compound (13)

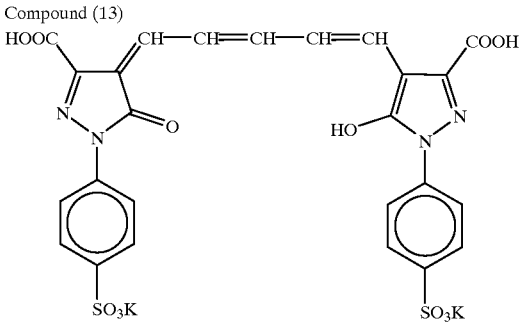

The kind and the amount of nucleating agent added to each light-sensitive material were changed as shown in Table 2, and the amount of compound (4) is shown in Table 2.

The composition of developing solutions is shown in Table 1.

TABLE 1

(Composition of Developing Solutions)

| | No. | | | | | |
|---|---|---|---|---|---|---|
| | 1 | 2 | 3 | 4 | 5 | 6 |
| Diethylenetri-aminepenta-acetic Acid (g) | 2 | 2 | 2 | 2 | 2 | 2 |
| Potassium Carbonate (g) | 33 | 33 | 33 | 33 | 33 | 33 |
| Sodium Carbonate (g) | 28 | 28 | 28 | 28 | 28 | 28 |
| Sodium Hydrogen-carbonate (g) | 25 | 25 | 25 | 25 | 25 | 25 |
| Sodium Erysorbate (g) | 45 | 45 | 45 | 45 | 45 | 45 |
| N-Methyl-p-aminophenol (g) | 7.5 | 7.5 | — | — | — | — |
| Compound (A-2) of Formula (II) (g) | — | — | 2 | 2 | 2 | 2 |
| Compound (A-23) of Formula (II) (g) | — | — | — | — | — | — |
| Compound (A-24) of Formula (II) (g) | — | — | — | — | — | — |
| KBr (g) | 2 | 2 | 2 | 2 | 2 | 2 |
| 5-Methyl-benzotriazole (g) | 0.004 | 0.004 | 0.004 | 0.004 | 0.004 | 0.004 |
| 1-Phenyl-5-mercapto-tetrazole (g) | 0.02 | 0.02 | 0.02 | 0.02 | 0.02 | 0.02 |
| Sodium Sulfite (g) | 2 | 2 | 2 | 2 | 2 | 15 |
| No. 53 of Formula (I) (g) | 0.3 | — | 0.3 | — | — | 0.3 |
| No. 13 of Formula (I) (g) | — | — | — | 0.3 | — | — |
| No. 70 of Formula (I) (g) | — | — | — | — | — | — |
| pH | 9.7 | 9.7 | 9.7 | 9.7 | 9.7 | 9.7 |
| Remark | Inven-tion | Com-parison | Inven-tion | Inven-tion | Com-parison | Com-parison |

TABLE 1-continued (Composition of Developing Solutions)

| | No. | | | | |
|---|---|---|---|---|---|
| | 7 | 8 | 9 | 10 | 11 |
| Diethylenetriamine-pentaacetic Acid (g) | 2 | 2 | 2 | 2 | 2 |
| Potassium Carbonate (g) | 33 | 33 | 33 | 33 | 33 |
| Sodium Carbonate (g) | 28 | 28 | 28 | 28 | 28 |
| Sodium Hydrogen-carbonate (g) | 25 | 25 | 25 | 25 | 25 |
| Sodium Erysorbate (g) | 45 | 45 | 45 | 45 | 45 |
| N-Methyl-p-amino-phenol (g) | — | — | — | — | — |
| Compound (A-2) of Formula (II) (g) | 2 | — | — | 2 | 2 |
| Compound (A-23) of Formula (II) (g) | — | 2 | — | — | — |
| Compound (A-24) of Formula (II) (g) | — | — | 2 | — | — |
| KBr (g) | 2 | 2 | 2 | 2 | 2 |
| 5-Methylbenzotriazole (g) | 0.004 | 0.004 | 0.004 | 0.004 | 0.004 |
| 1-Phenyl-5-mercapto-tetrazole (g) | 0.02 | 0.02 | 0.02 | 0.02 | 0.02 |
| Sodium Sulfite (g) | 2 | 2 | 2 | 2 | 2 |
| No. 53 of Formula (I) (g) | 0.3 | 0.3 | 0.3 | 0.3 | 0.3 |
| No. 13 of Formula (I) (g) | — | — | — | — | — |
| No. 70 of Formula (I) (g) | 0.3 | — | — | — | — |
| pH | 9.7 | 9.7 | 9.7 | 10.6 | 8.9 |
| Remark | Inven-tion | Inven-tion | Inven-tion | Com-parison | Com-parison |

In Table 1, water was added to bring the volume to 1 liter, and sodium hydroxide or acetic acid was used for the pH adjustment.

The formulation of a condensed fixing solution per liter of working solution is shown below:

| | |
|---|---|
| Ammonium Thiosulfate | 360 g |
| Disodium Ethylenediaminetetraacetate Dihydrate | 0.09 g |
| Sodium Thiosulfate Pentahydrate | 33.0 g |
| Sodium Metasulfite | 57.0 g |
| Sodium Hydroxide | 37.2 g |

-continued

| | |
|---|---|
| Acetic Acid (100%) | 90.0 g |
| Tartaric Acid | 8.7 g |
| Sodium Gluconate | 5.1 g |
| Aluminum Sulfate | 25.2 g |
| pH | 4.85 |

The above-mentioned condensed solution is diluted with water at a condensed solution : water ratio of 1:2 at the time of use. The pH of the working solution is 4.8.

The samples thus prepared were each exposed to xenon flash light having a light-emitting time of $10^{-5}$ second through an interference filter having a peak at 633 nm by the use of an optical wedge, and developed at 35° C. for 20 seconds, thereby evaluating the photographic characteristics. The sensitivity was indicated by a relative value, taking as 100 the reciprocal of an exposure necessary for obtaining a density of 1.5 at the time when each sample was processed with No. 1 of Table 2. The higher value shows the higher sensitivity. The gradation (gamma) was indicated by the following equation. The higher value shows the harder photographic characteristics.

Gamma=(3.0−0.3)/[log (an exposure giving a density of 3.0)−log (an exposure giving a density of 0.3)]

Results of the evaluation are shown in Table 2.

graphic characteristics were exposed in the same manner as with Example 1. The replenishment rate of the fixing solution in running was 1.5 times that of the developing solution.

The processing was conducted under conditions of a developing time of 20 seconds, a developing temperature of 35° C. and a fixing temperature of 34° C., and as mother liquors, the developing solutions of Example 1 were used as such. The pH of replenishers was adjusted as shown in Table 3. The sensitivity obtained by exhausted solutions after running is practically required to be within the range of 95 to 105.

The dot quality after running was evaluated by outputting 50% halftone dots (on 100 lines per inch) onto a coated light-sensitive material by the use of an SG-608 helium light source color scanner manufactured by Dainippon Screen Mfg. Co., Ltd., conducting the development under the above-mentioned conditions, and visually observing the definition of the edge of halftone dots with a magnifier having a magnification of ×200. Results of the evaluation are shown in Table 3 by the 5-point method grading from 1 (poor) to 5 (good). Practically, 3 or more is necessary.

TABLE 2

| | Nucleating Agent | | Nucleating Accelerator | | | | | |
|---|---|---|---|---|---|---|---|---|
| No. | Kind | Amount Added mol/mol-Ag | Kind | Amount Added mol/mol-Ag | Developing Solution No. | Sensitivity | Gradation | Remark |
| 1 | Compound (3) | $3 \times 10^{-4}$ | Compound (4) | $6 \times 10^{-4}$ | 1 | 100 | 22.0 | Invention |
| 2 | Compound (3) | $3 \times 10^{-4}$ | Compound (4) | $6 \times 10^{-4}$ | 2 | 101 | 22.3 | Comparison |
| 3 | Compound (3) | $3 \times 10^{-4}$ | Compound (4) | $6 \times 10^{-4}$ | 3 | 102 | 22.8 | Invention |
| 4 | Compound (3) | $3 \times 10^{-4}$ | Compound (4) | $6 \times 10^{-4}$ | 4 | 101 | 22.1 | Invention |
| 5 | Compound (3) | $3 \times 10^{-4}$ | Compound (4) | $6 \times 10^{-4}$ | 5 | 104 | 23.2 | Comparison |
| 6 | Compound (3) | $3 \times 10^{-4}$ | Compound (4) | $6 \times 10^{-4}$ | 6 | 100 | 22.9 | Invention |
| 7 | Compound (3) | $3 \times 10^{-4}$ | Compound (4) | $6 \times 10^{-4}$ | 7 | 101 | 22.7 | Invention |
| 8 | Compound (3) | $3 \times 10^{-4}$ | Compound (4) | $6 \times 10^{-4}$ | 8 | 99 | 22.5 | Invention |
| 9 | Compound (3) | $3 \times 10^{-4}$ | Compound (4) | $6 \times 10^{-4}$ | 9 | 100 | 22.3 | Invention |
| 10 | Compound (3) | $3 \times 10^{-4}$ | Compound (4) | $6 \times 10^{-4}$ | 10 | 107 | 25.9 | Comparison |
| 11 | Compound (3) | $3 \times 10^{-4}$ | Compound (4) | $6 \times 10^{-4}$ | 11 | 85 | 17.0 | Comparison |
| 12 | — | — | Compound (4) | $6 \times 10^{-4}$ | 3 | 78 | 6.9 | Comparison |
| 13 | 25c | $0.75 \times 10^{-4}$ | Compound (4) | $6 \times 10^{-4}$ | 6 | 101 | 22.4 | Invention |
| 14 | 26c | $0.75 \times 10^{-4}$ | Compound (4) | $6 \times 10^{-4}$ | 6 | 100 | 22.5 | Invention |
| 15 | 25c | $0.75 \times 10^{-4}$ | Compound (4) | $6 \times 10^{-4}$ | 7 | 100 | 22.0 | Invention |
| 16 | 26c | $0.75 \times 10^{-4}$ | Compound (4) | $6 \times 10^{-4}$ | 7 | 98 | 21.9 | Invention |
| 17 | 25c | $0.75 \times 10^{-4}$ | — | — | 9 | 80 | 7.2 | Comparison |
| 18 | 26c | $0.75 \times 10^{-4}$ | — | — | 9 | 81 | 7.3 | Comparison |

The results show that the combinations of compounds according to the present invention scarcely exhibit decreases in sensitivity and gradation, and give good photographic characteristics.

EXAMPLE 2

Running tests were conducted with an AP-560 processor manufactured by Fuji Photo Film Co., Ltd., using the light-sensitive materials, the developing solutions and the fixing solution used in Example 1. As to the running conditions, 16 sheets of each half-exposed sample of the large sheet size (50.8 cm×61.0 cm) were processed daily, and this was repeated 6 rounds, regarding as one round the running that the operation was carried out for 6 days and ceased for 1 day. The samples for evaluation of the photo The silver stain was visually evaluated in 5 grades after running.

A state in which no silver stain was developed on a film, and a development tank and rollers is taken as "5", and a state in which silver stain was developed on the whole surface of a film, and also on a development tank and rollers in large amounts is taken as "1". "4" is a practically allowable level in which silver stain is not developed on a film, but is developed a little on a development tank and rollers. "3" or less practically has a problem or an allowable level.

Results of the evaluation are shown in Table 3.

TABLE 3

| No. | Nucleating Agent Kind | Nucleating Agent Amount Added mol/mol-Ag | Nucleating Accelerator Kind | Nucleating Accelerator Amount Added mol/mol-Ag | Replenisher pH | Developing Solution No. | Developing Solution Replenishment Rate (ml/m$^2$) |
|---|---|---|---|---|---|---|---|
| 1 | 25c | $0.75 \times 10^{-4}$ | Compound (4) | $6 \times 10^{-4}$ | 9.7 | 1 | 160 |
| 2 | 25c | $0.75 \times 10^{-4}$ | Compound (4) | $6 \times 10^{-4}$ | 9.7 | 2 | 160 |
| 3 | 25c | $0.75 \times 10^{-4}$ | Compound (4) | $6 \times 10^{-4}$ | 9.7 | 3 | 160 |
| 4 | 25c | $0.75 \times 10^{-4}$ | Compound (4) | $6 \times 10^{-4}$ | 9.7 | 4 | 160 |
| 5 | 25c | $0.75 \times 10^{-4}$ | Compound (4) | $6 \times 10^{-4}$ | 9.7 | 5 | 160 |
| 6 | 25c | $0.75 \times 10^{-4}$ | Compound (4) | $6 \times 10^{-4}$ | 9.7 | 6 | 160 |
| 7 | 25c | $0.75 \times 10^{-4}$ | Compound (4) | $6 \times 10^{-4}$ | 9.7 | 7 | 160 |
| 8 | 25c | $0.75 \times 10^{-4}$ | Compound (4) | $6 \times 10^{-4}$ | 9.7 | 8 | 160 |
| 9 | 25c | $0.75 \times 10^{-4}$ | Compound (4) | $6 \times 10^{-4}$ | 10.6 | 10 | 160 |
| 10 | Compound (3) | $3 \times 10^{-4}$ | Compound (4) | $6 \times 10^{-4}$ | 9.7 | 3 | 80 |
| 11 | 25c | $0.75 \times 10^{-4}$ | Compound (4) | $6 \times 10^{-4}$ | 9.7 | 3 | 80 |
| 12 | 26c | $0.75 \times 10^{-4}$ | Compound (4) | $6 \times 10^{-4}$ | 9.7 | 3 | 80 |
| 13 | 25c | $0.75 \times 10^{-4}$ | Compound (4) | $6 \times 10^{-4}$ | 10.1 | 3 | 80 |
| 14 | 26c | $0.75 \times 10^{-4}$ | Compound (4) | $6 \times 10^{-4}$ | 10.1 | 3 | 80 |

| No. | Fresh Solution Sensitivity | Fresh Solution Gradation | After Running Sensitivity | After Running Gradation | After Running Dot Quality | After Running Silver Stain | Remark |
|---|---|---|---|---|---|---|---|
| 1 | 100 | 22.0 | 96 | 18.5 | 3.5 | 5.0 | Invention |
| 2 | 102 | 23.0 | 96 | 19.4 | 4.5 | 1.0 | Comparison |
| 3 | 101 | 22.5 | 97 | 19.0 | 4.5 | 5.0 | Invention |
| 4 | 100 | 22.4 | 98 | 20.5 | 4.5 | 5.0 | Invention |
| 5 | 102 | 22.8 | 99 | 20.3 | 4.5 | 1.0 | Comparison |
| 6 | 100 | 21.9 | 95 | 18.7 | 4.5 | 4.0 | Invention |
| 7 | 99 | 21.9 | 96 | 20.0 | 4.5 | 5.0 | Invention |
| 8 | 100 | 22.1 | 98 | 18.8 | 4.5 | 5.0 | Invention |
| 9 | 107 | 28.3 | 105 | 22.4 | 5.0 | 5.0 | Comparison |
| 10 | 100 | 22.4 | 93 | 12.1 | 4.0 | 4.0 | Invention |
| 11 | 101 | 22.2 | 96 | 19.1 | 4.5 | 4.0 | Invention |
| 12 | 100 | 23.0 | 95 | 19.0 | 4.5 | 4.0 | Invention |
| 13 | 100 | 22.7 | 99 | 22.1 | 4.5 | 4.0 | Invention |
| 14 | 101 | 21.6 | 100 | 21.0 | 4.5 | 4.0 | Invention |

The results show that the combinations of compounds according to the present invention cause decreased silver stain in running and slight changes in photographic characteristics, and give good dot quality. In particular, in the case of low replenishment, stable processability can be obtained by elevating the pH of the replenishers.

EXAMPLE 3

As a nucleating agent, a solid dispersion of a hydrazine compound was prepared as follows, and used. A 25% aqueous solution of Demol SNB manufactured by Kao Corp. was prepared. Then, 1.2 g of the aqueous solution of Demol SNB and 59 g of water were added to 1 g of the hydrazine compound, and mixed to form a slurry. This slurry was placed in a dispersing device (1/16 gallon, a sand grinder mill manufactured by Aimex Co. Ltd.), and dispersed for 10 hours using 200 g of glass beads having a diameter of 0.8 mm to 1.2 mm as a medium. Then, an aqueous solution of gelatin was added thereto and mixed therewith so as to give a hydrazine compound concentration of 1% and a gelatin concentration of 5%, and proxel was added as a preservative in an amount of 2000 ppm based on gelatin. Finally, ascorbic acid was added thereto to adjust the pH to 5.0.

A light-sensitive material using the solid dispersion of the hydrazine compound was tested in the same manner as with Example 2, and similar effects were obtained. The solid dispersion of the hydrazine compound was added in a 10-fold amount of the hydrazine compound in Example 1.

EXAMPLE 4

Preparation of Emulsion B

| | |
|---|---|
| Solution 1 | |
| Water | 1 liter |
| Gelatin | 20 g |
| Sodium Chloride | 3.0 g |
| 1,3-Dimethyl-2-imidazolidine-2-thione | 20 mg |
| Sodium Benzenethiosulfonate | 8 mg |
| Solution 2 | |
| Water | 0.4 liter |
| Silver Nitrate | 100 g |
| Solution 3 | |
| Water | 0.4 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 7 ml |

Solution 2 and solution 3 were concurrently added to solution 1 maintained at 40° C. at pH 4.5 with stirring for 15 minutes to form nuclear grains. Subsequently, solution 4 and solution 5 described below were added thereto for 15 minutes, and 0.15 g of potassium iodide was further added to terminate the grain formation.

| Solution 4 | |
|---|---|
| Water | 0.4 liter |
| Silver Nitrate | 100 g |
| Solution 5 | |
| Water | 0.4 liter |
| Sodium Chloride | 27.1 g |
| Potassium Bromide | 21.0 g |

Then, the grains were normally washed with water by the flocculation process, and 40 g of gelatin was added thereto.

After adjustment to pH 5.7 and pAg 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to give optimum sensitivity.

Further, 100 mg of 4-hydroxy-6-methyl-1,3,3a,7-tetraazaindene was added as a stabilizer, and phenoxyethanol was added as a preservative to finally obtain cubic silver chloroiodobromide emulsion B having a mean grain size of 0.23 μm and a silver chloride content of 70 mol %.

Preparation of Coated Samples

Sensitizing dyes (2) and (3) were added to emulsion B in amounts of $2.0\times10^{-4}$ mol/mol Ag and $7.0\times10^{-4}$ mol/mol Ag, respectively, and spectral sensitization was conducted. Further, $3.4\times10^{-4}$ mol/mol Ag of KBr, $5.0\times10^{-4}$ mol/mol Ag of compound (1), $8.0\times10^{-4}$ mol/mol Ag of compound (2), $1.2\times10^{-2}$ mol/mol Ag of hydroquinone, $1.8\times10^{-4}$ mol/mol Ag of compound (3), $4\times10^{-4}$ mol/mol Ag of compound (4), 30% by weight based on gelatin of a polyethyl acrylate latex, 15% by weight based on gelatin of colloidal silica having a grain size of 10 μm, and 4% by weight based on gelatin of compound (5) were added thereto. Then, a polyester support was coated therewith so as to give 3.4 g/m$^2$ of Ag and 1.5 g/m$^2$ of gelatin. An upper protective layer and a lower protective layer having the following compositions, respectively, were formed thereon, and an UL layer having the following composition was formed thereunder.

| Upper Protective Layer | |
|---|---|
| Gelatin | 0.3 g/m$^2$ |
| Silica Matte Agent (mean grain size: 3.5 μm) | 25 mg/m$^2$ |
| Compound (6) (gelatin dispersion) | 20 mg/m$^2$ |
| Colloidal Silica (grain size: 10–20 μm) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |
| Lower Protective Layer | |
| Gelatin | 0.5 g/m$^2$ |
| Compound (9) | 15 mg/m$^2$ |
| 1,5-Dihydroxy-2-benzaldoxime | 10 mg/m$^2$ |
| Polyethyl Acrylate Latex | 250 mg/m$^2$ |
| UL Layer | |
| Gelatin | 0.5 g/m$^2$ |
| Polyethyl Acrylate Latex | 150 mg/m$^2$ |
| Compound (5) | 40 mg/m$^2$ |

The supports of the samples used in the present invention each has a back layer and a conductive layer having the following compositions, respectively:

| Back Layer | |
|---|---|
| Gelatin | 3.3 g/m$^2$ |
| Sodium Dodecylbenzenesulfonate | 80 mg/m$^2$ |
| Compound (10) | 90 mg/m$^2$ |
| Compound (11) | 20 mg/m$^2$ |
| Compound (12) | 40 mg/m$^2$ |
| 1,3-Divinylsulfonyl-2-propanol | 60 mg/m$^2$ |
| Fine Polymethyl Methacrylate Grains (mean grain size: 6.5 μm) | 20 mg/m$^2$ |
| Compound (5) | 120 mg/m$^2$ |
| Conductive Layer | |
| Gelatin | 0.1 g/m$^2$ |
| Sodium Dodecylbenzenesulfonate | 20 mg/m$^2$ |
| $SnO_2$/Sb (weight ratio: 9/1, mean grain size: 0.25 μm) | 200 mg/m$^2$ |

Sensitizing Dye (2)

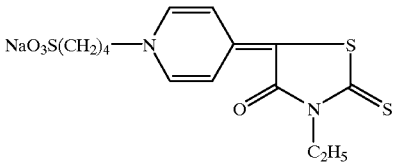

Sensitizing Dye (3)

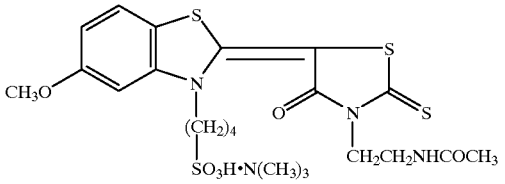

The kind and the amount of nucleating agent added to each light-sensitive material were changed as shown in Table 4, and the amount of compound (4) is shown in Table 4.

Running tests were conducted with an FG-520AG processor manufactured by Fuji Photo Film Co., Ltd., using the developing solutions and the fixing solution used in Example 1. As to the running conditions, 16 sheets of each half-exposed sample of the large sheet size (50.8 cm×61.0 cm) were processed daily, and this was repeated 6 rounds, regarding as one round the running that the operation was carried out for 6 days and ceased for 1 day. The samples for evaluation of the photographic characteristics were exposed in the same manner as with Example 1 with the exception that an interference filter having a peak at 488 nm was used in place of the interference filter having a peak at 633 nm. The replenishment rate of the fixing solution in running was 1.5 times that of the developing solution.

The processing was conducted under conditions of a developing time of 20 seconds, a developing temperature of 35° C. and a flixing temperature of 34° C., and as mother liquors, the developing solutions of Example 1 were used as such. The pH of replenishers was adjusted as shown in Table 4. The sensitivity obtained by exhausted solutions after running is practically required to be within the range of 95 to 105.

The dot quality after running was evaluated by outputting 50% halftone dots (on 100 lines per inch) onto a coated light-sensitive material by the use of an M-656 argon light source color scanner manufactured by Crossfield Co., conducting the development under the above-mentioned conditions, and visually observing the definition of halftone dots with a magnifier having a magnification of ×200. Results of the evaluation are shown in Table 4 by the 5-point method grading from 1 (poor) to 5 (good). Practically, 3 or more is necessary.

Results of the evaluation are shown in Table 4.

TABLE 4

| | Nucleating Agent | | Nucleating Accelerator | | | | |
|---|---|---|---|---|---|---|---|
| No. | Kind | Amount Added mol/mol-Ag | Kind | Amount Added mol/mol-Ag | Replenisher pH | Developing Solution No. | Developing Solution Replenishment Rate (ml/m$^2$) |
| 1 | Compound (3) | $6 \times 10^{-4}$ | Compound (4) | $4 \times 10^{-4}$ | 10.1 | 3 | 80 |
| 2 | 25c | $1.5 \times 10^{-4}$ | Compound (4) | $4 \times 10^{-4}$ | 10.1 | 3 | 80 |
| 3 | 26c | $1.5 \times 10^{-4}$ | Compound (4) | $4 \times 10^{-4}$ | 10.1 | 3 | 80 |
| 4 | 25c | $1.5 \times 10^{-4}$ | Compound (4) | $4 \times 10^{-4}$ | 10.1 | 5 | 80 |
| 5 | 25c | $1.5 \times 10^{-4}$ | Compound (4) | $4 \times 10^{-4}$ | 10.1 | 4 | 80 |

| | Fresh Solution | | After Running | | | | |
|---|---|---|---|---|---|---|---|
| No. | Sensitivity | Gradation | Sensitivity | Gradation | Dot Quality | Silver Stain | Remark |
| 1 | 100 | 21.5 | 95 | 18 | 4.0 | 4.0 | Invention |
| 2 | 100 | 21.8 | 96 | 19.3 | 4.5 | 4.0 | Invention |
| 3 | 100 | 22.3 | 96 | 19.1 | 4.5 | 4.0 | Invention |
| 4 | 99 | 22.5 | 97 | 20.1 | 4.5 | 1.0 | Comparison |
| 5 | 101 | 22.0 | 96 | 19.0 | 4.5 | 4.0 | Invention |

As a result, effects similar to those obtained in Example 2 were obtained.

EXAMPLE 5

Preparation of Emulsion C

| | |
|---|---|
| Solution 1 | |
| Water | 1 liter |
| Gelatin | 20 g |
| Sodium Chloride | 2.0 g |
| 1,3-Dimethyl-2-imidazolidine-2-thione | 20 mg |
| Sodium Benzenethiosulfonate | 8 mg |
| Solution 2 | |
| Water | 0.4 liter |
| Silver Nitrate | 100 g |
| Solution 3 | |
| Water | 0.4 ml |
| Sodium Chloride | 21.9 g |
| Potassium Bromide | 31.5 g |
| Ammonium Hexachloroiridate (III) (0.001% aqueous solution) | 10 ml |
| Potassium Hexachlororhodate (III) (0.001% aqueous solution) | 5 ml |

Solution 2 and solution 3 were concurrently added to solution 1 maintained at 42° C. at pH 4.5 with stirring for 15 minutes to form nuclear grains. Subsequently, solution 4 and solution 5 described below were added thereto for 15 minutes, and 0.15 g of potassium iodide was further added to terminate the grain formation.

| | |
|---|---|
| Solution 4 | |
| Water | 0.4 liter |
| Silver Nitrate | 100 g |

-continued

| | |
|---|---|
| Solution 5 | |
| Water | 0.4 liter |
| Sodium Chloride | 25.4 g |
| Potassium Bromide | 24.5 g |

Then, the grains were normally washed with water by the flocculation process, and 62 g of gelatin was added thereto.

After adjustment to pH 5.9 and pAg 7.5, 2.0 mg of sodium thiosulfate, 8.0 mg of chloroauric acid, 2.0 mg of triphenylphosphine selenide, 4 mg of sodium benzenethiosulfonate and 1 mg of sodium benzenethiosulfinate were added to conduct chemical sensitization at 60° C. so as to give optimum sensitivity.

Further, 150 mg of 4-hydroxy-6-methyl-1,3,3a,7-tetraazaindene was added as a stabilizer, and phenoxyethanol was added as a preservative to finally obtain cubic silver chloroiodobromide emulsion C having a mean grain size of 0.24 $\mu$m and a silver chloride content of 60 mol %.

Preparation of Coated Samples

Sensitizing dye (4) was added to emulsion C in an amount of $7.0\times10^{-4}$ mol/mol Ag, and spectral sensitization was conducted. Further, $4.0\times10^{-3}$ mol/mol Ag of KBr, $2.5\times10^{-4}$ mol/mol Ag of compound (1), $8.0\times10^{-4}$ mol/mol Ag of compound (2), $1.5\times10^{-2}$ mol/mol Ag of hydroquinone, $2.0\times10^{-4}$ mol/mol Ag of compound (3), $5.0\times10^{-4}$ mol/mol Ag of compound (4), 40% by weight based on gelatin of a polyethyl acrylate latex, 25% by weight based on gelatin of colloidal silica having a grain size of 10 $\mu$m, and 4% by weight based on gelatin of compound (5) were added thereto. Then, a polyester support was coated therewith so as to give 3.2 g/m$^2$ of Ag and 1.8 g/m$^2$ of gelatin. An upper protective layer and a lower protective layer having the following compositions, respectively, were formed thereon.

| Upper Protective Layer | |
|---|---|
| Gelatin | 0.3 g/m$^2$ |
| Silica Matte Agent (mean grain size: 3.5 μm) | 35 mg/m$^2$ |
| Compound (6) (gelatin dispersion) | 20 mg/m$^2$ |
| Colloidal Silica (grain size: 10–20 μm) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |
| **Lower Protective Layer** | |
| Gelatin | 0.5 g/m$^2$ |
| Compound (9) | 10 mg/m$^2$ |
| Compound (10) | 50 mg/m$^2$ |
| Compound (11) | 20 mg/m$^2$ |
| 1,5-Dihydroxy-2-benzaldoxime | 10 mg/m$^2$ |
| Polyethyl Acrylate Latex | 250 mg/m$^2$ |

The supports of the samples used in the present invention each has a back layer and a conductive layer having the following compositions, respectively:

| Back Layer | |
|---|---|
| Gelatin | 2.5 g/m$^2$ |
| Sodium Dodecylbenzenesulfonate | 30 mg/m$^2$ |
| Compound (12) | 50 mg/m$^2$ |
| Compound (13) | 30 mg/m$^2$ |
| Compound (14) | 30 mg/m$^2$ |
| Compound (15) | 90 mg/m$^2$ |
| Compound (16) | 140 mg/m$^2$ |
| **Conductive Layer** | |
| Gelatin | 1.0 g/m$^2$ |
| 1,3-Divinylsulfonyl-2-propanol | 20 mg/m$^2$ |
| Fine Polymethyl Methacrylate Grains (mean grain size: 3.5 μm) | 10 mg/m$^2$ |
| Sodium Dodecylbenzenesulfonate | 20 mg/m$^2$ |

Sensitizing Dye (4)

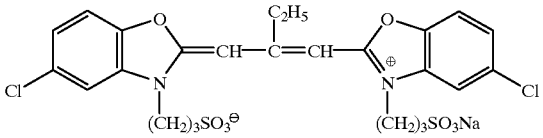

Compound (14)

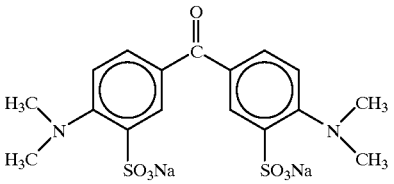

Compound (15)

$HO(CH_2CH_2O)_nCH_2CH_2OH$ (molecular weight: 1000)

-continued

Compound (16)

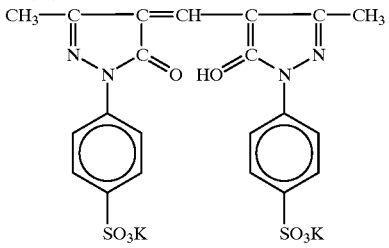

The kind and the amount of nucleating agent added to each light-sensitive material were changed as shown in Table 5, and the amount of compound (4) is shown in Table 5.

Running tests were conducted with an FG-520AG processor manufactured by Fuji Photo Film Co., Ltd., using the developing solutions and the fixing solution used in Example 1. As to the running conditions, 16 sheets of each half-exposed sample of the large sheet size (50.8 cm×61.0 cm) were processed daily, and this was repeated 6 rounds, regarding as one round the running that the operation was carried out for 6 days and ceased for 1 day. The samples for evaluation of the photographic characteristics were exposed to tungsten light of 3200° K. through a step wedge. The replenishment rate of the fixing solution in running was 1.5 times that of the developing solution.

The processing was conducted under conditions of a developing time of 20 seconds, a developing temperature of 35° C. and a fixing temperature of 34° C., and as mother liquors, the developing solutions of Example 1 were used as such. The pH of replenishers was adjusted as shown in Table 5. The sensitivity obtained by exhausted solutions after running is practically required to be within the range of 95 to 105.

Results of the evaluation are shown in Table 5.

TABLE 5

| No. | Nucleating Agent Kind | Nucleating Agent Amount Added mol/mol-Ag | Nucleating Accelerator Kind | Nucleating Accelerator Amount Added mol/mol-Ag | Replenisher pH | Developing Solution No. | Developing Solution Replenishment Rate ($ml/m^2$) |
|---|---|---|---|---|---|---|---|
| 1 | Compound (3) | $6 \times 10^{-4}$ | Compound (4) | $5 \times 10^{-4}$ | 10.1 | 3 | 80 |
| 2 | 25c | $1.5 \times 10^{-4}$ | Compound (4) | $5 \times 10^{-4}$ | 10.1 | 3 | 80 |
| 3 | 26c | $1.5 \times 10^{-4}$ | Compound (4) | $5 \times 10^{-4}$ | 10.1 | 3 | 80 |
| 4 | 25c | $1.5 \times 10^{-4}$ | Compound (4) | $5 \times 10^{-4}$ | 10.1 | 5 | 80 |
| 5 | 25c | $1.5 \times 10^{-4}$ | Compound (4) | $5 \times 10^{-4}$ | 10.1 | 4 | 80 |

| No. | Fresh Solution Sensitivity | Fresh Solution Gradation | After Running Sensitivity | After Running Gradation | Silver Stain | Remark |
|---|---|---|---|---|---|---|
| 1 | 100 | 22.1 | 95 | 19 | 4.0 | Invention |
| 2 | 101 | 22.0 | 97 | 19.0 | 4.0 | Invention |
| 3 | 100 | 22.6 | 98 | 18.9 | 4.0 | Invention |
| 4 | 100 | 21.9 | 97 | 19.7 | 1.0 | Comparison |
| 5 | 100 | 21.9 | 98 | 19.5 | 4.0 | Invention |

As a result, effects similar to those obtained in Example 2 were obtained.

While the invention has been described in detail and with reference to specific examples thereof, it will be apparent to one skilled in the art that various changes and modifications can be made therein without departing from the spirit and scope thereof.

What is claimed is:

1. A development processing method which comprises:

exposing a silver halide light sensitive material comprising a support having thereon at least one light-sensitive silver halide emulsion layer; and developing said exposed light-sensitive material with a developing solution, wherein at least one of said silver halide emulsion layer and other hydrophilic colloidal layers contains at least one hydrazine derivative, and wherein said developing solution is substantially free from a dihydroxybenzene compound, has a pH of from 9.0 to 10.5, and contains (1) at least one ascorbic acid derivative developing agent, (2) at least one aminophenol auxiliary developing agent and (3) a compound represented by formula (I):

(I)

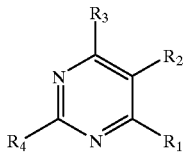

wherein $R_1$ to $R_4$, which may be the same or different, each represents a hydrogen atom, a halogen atom or a substituent group bonded to the ring in formula (I) with a carbon atom, a nitrogen atom, an oxygen atom, a sulfur atom or a phosphorus atom contained in the substituent, with the proviso that $R_1$ and $R_3$ each does not represent a hydroxyl group, and that at least two of $R_1$ to $R_4$ are —SM groups, wherein M represents a hydrogen atom, an alkali metal atom or an ammonium group;

wherein $R_1$ and $R_2$ in formula (I) are not connected to each other to form a ring; and wherein the compound represented by formula (I) is present in an amount of from 0.1 to 5 mmol per liter of the developing solution.

2. The development processing method according to claim 1, wherein said aminophenol compound is represented by formula (II):

(II)

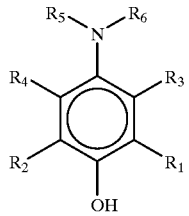

wherein $R_1$ to $R_4$, which may be the same or different, each represents a hydrogen atom or a substituent group; and $R_5$ and $R_6$, which may be the same or different, each represents an alkyl group, an aryl group, an aralkyl group or a heterocyclic group.

3. The development processing method according to claim 1, wherein said developing solution has a carbonate concentration of not less than 0.3 mol/liter.

4. The development processing method according to claim 1, wherein said silver halide light-sensitive material comprises an amine derivative, an onium salt, a disulfide derivative or a hydroxymethyl derivative as a nucleating accelerator.

5. The development processing method according to claim 1, wherein said developing solution has a sulfite ion concentration of not more than 0.1 mol/liter.

6. The development processing method according to claim 1, wherein said development is conducted with a developing solution replenishment rate of not more than 180 ml per processing of 1 $m^2$ of said light-sensitive material.

* * * * *